US011081800B2

(12) United States Patent
Vollmer et al.

(10) Patent No.: US 11,081,800 B2
(45) Date of Patent: Aug. 3, 2021

(54) DUAL-POLARIZED ANTENNA

(71) Applicant: Telefonaktiebolaget LM Ericsson (publ), Stockholm (SE)

(72) Inventors: Andreas Vollmer, Rosenheim (DE); Maximilian Goettl, Frasdorf (DE); Dan Fleancu, Griesstaett (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 445 days.

(21) Appl. No.: 16/075,097

(22) PCT Filed: Feb. 3, 2017

(86) PCT No.: PCT/EP2017/000143

§ 371 (c)(1),
(2) Date: Aug. 2, 2018

(87) PCT Pub. No.: WO2017/133849

PCT Pub. Date: Aug. 10, 2017

(65) Prior Publication Data

US 2019/0044243 A1 Feb. 7, 2019

(30) Foreign Application Priority Data

Feb. 5, 2016 (DE) ..... 10 2016 001 327.3

(51) Int. Cl.
*H01Q 13/18* (2006.01)
*H01Q 9/28* (2006.01)
(Continued)

(52) U.S. Cl.
CPC ..... *H01Q 13/18* (2013.01); *H01Q 1/246* (2013.01); *H01Q 9/065* (2013.01); *H01Q 9/24* (2013.01); *H01Q 9/28* (2013.01); *H01Q 21/24* (2013.01)

(58) Field of Classification Search
CPC ..... H01Q 13/18; H01Q 21/24; H01Q 1/246; H01Q 9/065; H01Q 9/24; H01Q 9/28; H01Q 21/062; H01Q 13/10
See application file for complete search history.

(56) References Cited

U.S. PATENT DOCUMENTS 2,990,547 A 6/1961 McDougal
3,623,112 A * 11/1971 Rupp ..... H01Q 9/065 343/727

(Continued)

FOREIGN PATENT DOCUMENTS

CN 101465475 A 6/2009
CN 201629409 U 11/2010

(Continued)

OTHER PUBLICATIONS

Cox, R. et al., "Circularly polarized phased array antenna element," IEEE Transactions on Antennas and Propagation, vol. 18, No. 6, Nov. 1970, 4 pages.

(Continued)

*Primary Examiner* — Dameon E Levi
*Assistant Examiner* — David E Lotter
(74) *Attorney, Agent, or Firm* — Withrow & Terranova, PLLC

(57) ABSTRACT

The present disclosure relates to a dual-polarized antenna comprising a dipole radiator, a resonant cavity radiator and a reflector. The resonant cavity radiator is arranged below the reflector and radiates through a slot in the reflector, and the dipole radiator is arranged above the reflector, with a signal line and/or a carrier of the dipole radiator extending through the slot.

16 Claims, 21 Drawing Sheets

(51) Int. Cl.

| | |
|---|---|
| ***H01Q 21/24*** | (2006.01) |
| ***H01Q 1/24*** | (2006.01) |
| ***H01Q 9/06*** | (2006.01) |
| ***H01Q 9/24*** | (2006.01) |

(56) References Cited

U.S. PATENT DOCUMENTS

| | | | | |
|---|---|---|---|---|
| 4,839,663 | A * | 6/1989 | Kurtz | H01Q 21/245 343/727 |
| 4,905,013 | A * | 2/1990 | Reindel | H01Q 9/065 333/21 A |
| 5,272,487 | A | 12/1993 | Pantsios | |
| 6,166,701 | A | 12/2000 | Park et al. | |
| 6,424,309 | B1 | 7/2002 | Johnston et al. | |
| 7,498,994 | B2 | 3/2009 | Vacanti | |
| 8,704,718 | B2 * | 4/2014 | Guler | H01P 5/107 343/727 |
| 2012/0081255 | A1 * | 4/2012 | Gunnels | H01Q 21/24 343/725 |

FOREIGN PATENT DOCUMENTS

| | | | |
|---|---|---|---|
| CN | 102420352 | A | 4/2012 |
| EP | 2256864 | A1 | 12/2010 |

OTHER PUBLICATIONS

ISA European Patent Office, International Search Report Issued in Application No. PCT/EP2017/000143, dated May 8, 2017, WIPO, 6 pages.

Muller, D.J. et al., "A Cavity-Backed Thin Combined Slot-Dipole Antenna for Mobile Reception of Satellite Signals in Automotive Applications," 2009 IEEE Antennas and Propagation Society International Symposium, Jun. 1-5, 2009, Charleston, SC, IEEE, 4 pages.

Search Report for Chinese Patent Application No. 2017800103048, dated Jan. 10, 2020, 2 pages.

First Office Action for Chinese Patent Application No. 2017800103048, dated Jan. 19, 2020, 16 pages.

Second Office Action for Chinese Patent Application No. 2017800103048, dated Jul. 27, 2020, 18 pages.

Examination Report for European Patent Application No. 17704662.0, dated Jul. 18, 2019, 9 pages.

Examination Report for European Patent Application No. 17704662.0, dated Jul. 20, 2020, 7 pages.

Written Opinion for International Patent Application No. PCT/EP2017/000143, dated May 8, 2017, 15 pages.

* cited by examiner preferably <0.15A
preferably <0.15A
preferably <0.15A
<0.25A
<0.25A
<0.25A
0.1A-0.6A ( preferably 0.15A-0.35A)
0.1A-0.6A ( preferably 0.15A-0.35A)
L4 preferably 0.2A-0.3A
L8 preferably 0.4A-0.8A
L9 preferably 0.5A-1A
0.1A-0.6A preferably 0.2A-0.3A
0.2A-1A preferably 0.4A-0.8A
0.3A-1.5A preferably 0.5A-1A

41

DUAL-POLARIZED ANTENNA

CROSS-REFERENCE TO RELATED APPLICATIONS

The present application is a U.S. National Phase of International Patent Application Serial No. PCT/EP2017/000143, entitled "DUAL-POLARIZED ANTENNA," filed on Feb. 3, 2017. International Patent Application Serial No. PCT/EP2017/000143 claims priority to German Patent Application No. 10 2016 001 327.3, filed on Feb. 5, 2016. The entire contents of each of the above-mentioned applications are hereby incorporated by reference in their entirety for all purposes.

TECHNICAL FIELD

The present invention relates to a dual-polarized antenna comprising a dipole radiator, a resonant cavity radiator and a reflector. In particular, it relates to a dual-polarized antenna for a mobile phone base station.

BACKGROUND AND SUMMARY

In the field of mobile communication antennas, dual-polarized antennas are usually provided by the dipoles or slot radiators, the two orthogonal polarizations being generated by a 90° rotation of two identical radiators. However, dual-polarized antennas thus require a comparatively large volume in both polarization directions.

Several attempts have already been made to improve the space requirement of orthogonally polarized antennas by using different radiators and in particular by a combination of a dipole radiator and a resonant cavity radiator or a slot radiator.

Reference U.S. Pat. No. 6,166,701 A discloses a dual-polarized antenna array, in the case of which a plurality of cavity resonators, which radiate through slots in the upper surface thereof, are arranged side by side. Between the individual cavity resonators, plates are arranged, which carry a plurality of dipole antennas. Both the resonant cavity radiators and the dipole radiators have signals supplied thereto via cavity waveguides.

In addition, reference US 2012/0081255 A1 discloses a dual-polarized antenna, in the case of which one of the two polarizations is provided by means of a box, which is open at the top and which acts as a slot radiator. A dipole radiator, which provides the second polarization, extends beyond the box. The box with the dipole radiator is arranged on a reflector.

References EP 2 256 864 A1, U.S. Pat. Nos. 5,272,487 A, 4,839,663 A and CN 102420352 A each show antenna arrays, in which dipole radiators are arranged in the area of a slot radiator and are connected in parallel thereto.

Further antenna arrays are known from U.S. Pat. No. 7,498,994 B2 and U.S. Pat. No. 6,424,309 B1.

It is the object of the present invention to provide a compact dual-polarized antenna. The dual-polarized antenna should preferably have a small radiation angle.

According to the present invention, this object is achieved by a dual-polarized antenna according to claim 1. Preferred further developments of the present invention are the subject matter of the subclaims.

The present invention comprises a dual-polarized antenna with a dipole radiator, a resonant cavity radiator and a reflector. According to the present invention, the resonant cavity radiator is arranged below the reflector and radiates through a slot in the reflector. The dipole radiator is arranged above the reflector. In a first variant, a signal line of the dipole radiator extends through the slot in the reflector. In a second variant, a carrier of the dipole radiator extends through the slot. Both variants are, independently of each other, the subject matter of the present invention. However, the two variants are preferably used in combination.

Other than known dual-polarized antennas consisting of a combination of two identical radiators rotated by 90° relative to each other, the dual-polarized antenna according to the present invention thus comprises two radiators of different structural designs. This results in a compact structural design in the direction of one of the polarizations as well as in combination and interleaving possibilities with further antennas. In addition, due to the fact that the radiators are arranged above and below the reflector, a good separation between the dipole radiator and the resonant cavity radiator as well as a good directional characteristic are accomplished. The signal line extending through the slot prevents disturbances in the radiation characteristic of the resonant cavity radiator. The carrier extending through the slot allows a particularly simple construction and simple positioning of the dipole radiator above the slot. Preferably, the signal line and/or the carrier extend(s) from the cavity of the resonant cavity radiator upwards through the slot.

Preferably, the dual-polarized antenna of the present invention is an antenna for a mobile phone base station.

Preferably, the dipole radiator is electrically connected to a feed point by means of the signal line extending through the slot, the feed point being arranged below the reflector. At the feed point, the signal line may e.g. be connected to a coaxial cable. According to an alternative embodiment, in which only the carrier extends through the slot, the feed point may, however, also be located above the reflector.

Alternatively or additionally, the dipole radiator is mechanically held at a fastening point arranged below the reflector preferably by means of the carrier extending through the slot, and in particular it is connected via the carrier to the housing defining the cavity of the cavity resonator.

According to a first embodiment of the present invention, the dipole radiator and/or the signal line of the dipole radiator are defined by the metallization of a printed circuit board, which extends from the cavity of the resonant cavity radiator upwards through the slot. The printed circuit board thus defines the carrier of the dipole radiator and carries, in addition, the signal line of the dipole radiator.

The signal line may especially be configured as a microstrip line and/or a coupled microstrip line and/or a coplanar strip line or a coplanar slot line on the printed circuit board, which extends on the printed circuit board from the cavity upwards through the slot. The two arms of the dipole radiator are preferably defined by a metallization of the printed circuit board, which is applied to the latter on one side thereof in the case of a balanced signal line. In the case of an unbalanced signal line, the two arms of the dipole radiator are preferably defined by a metallization of the printed circuit board applied to both sides of the latter.

The printed circuit board preferably comprises a feed point of the dipole radiator. Alternatively or additionally, it may have one or a plurality of mechanical fastening points for fastening to the housing defining the cavity of the cavity resonator.

According to possible embodiments of the present invention, the metallization of the printed circuit board may also comprise impedance matching means and/or a filter structure and/or a hybrid coupler and/or a balun and/or a field symmetrizing structure for feeding symmetrical and/or differential antennas.

Preferably, the printed circuit board extends perpendicular to the plane of the reflector through the slot. The printed circuit board extends here preferably parallel to the longitudinal axis of the slot and/or along a central axis of the slot.

The printed circuit board may be mechanically connected to a base plate, the sidewalls, the ceiling plate of the cavity or to lateral ends of the slot.

According to a second embodiment of the present invention, the dipole radiator and/or the signal line of the dipole radiator and/or the carrier of the dipole radiator are realized by a sheet metal structure and/or as air ducts. In particular, the signal lines defined by a sheet metal structure may simultaneously also define the carrier of the dipole radiator. In this case, further carrier elements for the sheet metal structure may additionally be provided, which need not necessarily extend through the slot and which may consist e.g. of a dielectric material. Preferably, a base area of the sheet metal structure defines the signal line of the dipole radiator and/or the carrier of the dipole radiator and extends from the cavity of the cavity radiator upwards through the slot. Furthermore, a head area of the sheet metal structure may define the dipole radiator.

The sheet metal structure may be configured in the same way as and/or comprise the same components as the above described metallization of a printed circuit board, the only difference being that, other than in the case of the embodiment comprising a printed circuit board, no substrate is used.

The sheet metal structure may be punched from a sheet metal plate and/or formed by angling sheet metal elements.

Furthermore, an excitation structure for exciting the cavity resonator may be provided, the excitation structure extending in the interior of the cavity of the resonant cavity radiator. The excitation structure may especially be defined by two conductors extending in the interior of the cavity.

Preferably, the excitation structure and/or the conductors extend perpendicular to the longitudinal axis of the slot and/or parallel to the plane of the reflector. In particular, the excitation structure may extend perpendicular to a printed circuit board carrying the dipole radiator and/or the signal line of the dipole radiator.

Alternatively or additionally, the excitation structure may be arranged in the cavity centrally below the slot, with respect to the longitudinal dimension of the slot.

According to a first embodiment, the conductors of the excitation structure are the inner conductor and the outer conductor of a coaxial cable. In particular, a coaxial cable area, which comprises an outer conductor and an inner conductor, may extend from a sidewall of the cavity up to a point below the slot. From there, the inner conductor preferably continues in the direction of the other sidewall, whereas the outer conductor ends below the slot. The outer conductor and/or the inner conductor may be electrically coupled to the respective sidewall, in particular capacitively or galvanically.

According to a second embodiment, the conductors of the excitation structure are air waveguides. In particular, the excitation structure may here be configured as a sheet metal structure.

According to a third embodiment, the conductors of the excitation structure of the cavity radiator are defined by the metallization of a printed circuit board. The printed circuit board may here preferably extend perpendicular to a printed circuit board carrying the signal line and/or the dipole radiator. Preferably, a microstrip line and/or a coupled microstrip line and/or a coplanar strip line or a coplanar slot line are here provided, which extend from a sidewall up to a point below the slot, one of the conductors continuing from this point in the direction of the second sidewall, whereas the other conductor ends below the slot.

Furthermore, the excitation structure and/or the printed circuit board carrying the excitation structure may comprise a feed point, which is arranged outside the cavity radiator. Preferably, a coaxial cable is contacted in the feed point with a line arranged on the printed circuit board or defined by a sheet metal structure. Preferably, the printed circuit board or the sheet metal structure extends here through an opening in a sidewall of the cavity of the resonant cavity radiator in the area of the feed point. The printed circuit board or the sheet metal structure may be mechanically connected to one or both sidewalls of the cavity.

Independently of the concrete structural design of the conductors of the excitation structure, the first conductor preferably extends, along a first part of its extension, parallel to the second conductor and defines together therewith a closed or an open waveguide. Preferably, the second conductor ends here below the slot. Further preferred, the second part of the conductor extends freely, so that the free part of the second conductor defines together with the first conductor the excitation structure for the cavity resonator. One of the conductors or both conductors may here be electrically coupled to the sidewalls of the resonator.

According to a possible embodiment of the present invention, the excitation structure of the resonant cavity radiator and in particular at least one conductor of the excitation structure may extend through an opening in the carrier and in particular through an opening in the printed circuit board carrying the dipole radiator and/or the signal line of the dipole radiator or in the sheet metal structure defining these components. In this way, a particularly compact structural design is obtained. The opening in the printed circuit board or in the sheet metal structure through which the excitation structure extends may be closed, i.e. it may define a break through the printed circuit board or the sheet metal structure. In a different embodiment, the opening may, however, also be open to the outside, e.g. in the form of a slot, which will simplify assembly even further, since the excitation structure of the resonant cavity radiator and the printed circuit board or the sheet metal structure for the dipole radiator can thus be pushed into one another. In particular, a printed circuit board carrying the excitation structure or a sheet metal structure defining this excitation structure can here extend through the opening in the printed circuit board carrying the dipole radiator and/or the signal line of the dipole radiator or in the sheet metal structure defining these components. In this case, the opening is preferably an opening that is open to the outside.

According to the present invention, the excitation structure and preferably both conductors of the excitation structure of the resonant cavity radiator may, in addition, extend through a sidewall of the cavity of the cavity resonator into the cavity. In this way, a particularly compact connection for the excitation structure of the resonant cavity radiator is obtained. Preferably, the excitation structure of the resonant cavity radiator is mechanically connected to the sidewall of the cavity of the cavity resonator and is, in particular, secured in position in the break in the sidewall of the cavity of the cavity resonator, through which the excitation structure extends into the cavity. According to a possible embodiment of the present invention, the excitation structure may also be mechanically connected to the opposite sidewall of the cavity.

Preferably, the feed point of the dipole radiator is, in the case of the dual-polarized antenna according to the present invention, arranged below an excitation structure of the resonant cavity radiator in the cavity of the resonant cavity radiator, in particular in a bottom area of the cavity. Alternatively, the feed point may also be arranged outside of and preferably below the cavity of the resonant cavity radiator, in particular below a base plate of the cavity. In both cases, the radiation of the resonant cavity radiator will not be influenced by the coupling of the dipole radiator, or it will only be influenced to a minor extent.

Preferably, a coaxial cable may be contacted in the feed point of the dipole radiator with a line arranged on a printed circuit board or defined by a sheet metal structure. If the feed point is located in the cavity of the cavity resonator, the coaxial cable will preferably extend in the base area of the cavity above the base plate, and will thus have only a minor influence on the radiation pattern of the resonant cavity radiator. The influence will decrease still further, if the feed point is provided below the cavity and in particular below a base plate of the cavity, so that the coaxial cable extends outside the cavity. In particular, an area of the printed circuit board or of the sheet metal structure, which carries the feed point, may here extend through the base plate of the cavity.

The excitation structure may comprise at least one metallic matching structure and/or radiator structure. Such a matching structure and/or radiator structure will be able to simplify the detachment of the wave from the excitation structure.

Preferably, the matching structure and/or the radiator structure enlarge the width of the conductors of the excitation structure towards the outside.

Alternatively or additionally, the matching structure and/or the radiator structure may comprise a metallic body, the metallic body being preferably arranged around the excitation structure of the cavity resonator. Preferably, a metallic body is arranged around both conductors of the excitation structure, said metallic body including further preferred a cylindrical and/or conical portion. Further preferred, the conductors of the excitation structure of the resonant cavity radiator may extend axially through the bodies.

The matching structure and/or the radiator structure may define an additional radiator, in particular a dipole radiator, which excites the resonant cavity radiator. Alternatively or additionally, the matching structure and/or the radiator structure may act as a parasitic element.

According to a possible embodiment of the present invention, the cavity of the resonant cavity radiator may have arranged therein at least one dielectric body. The size of the cavity can be reduced in this way.

Further preferred, the resonant cavity radiator may be filled with one or a plurality of metallic and/or dielectric bodies at locations of high and/or low electric field strengths.

According to the present invention, collar-shaped wall areas may extend along the edges of the slot. The edges of the slot are thus defined by wall areas, which extend at least also in a height direction. The wall areas defining the edges improve here the directional characteristic of the resonant cavity radiator substantially. The wall areas may extend above and/or below the reflector. According to a preferred embodiment, the wall areas extend circumferentially along the edges of the slot.

Preferably, the wall areas define a step with the reflector. According to a particularly preferred embodiment, the wall areas may extend perpendicular to the plane defined by the reflector. However, also arrangements in which the wall areas extend at an oblique angle to the plane of the reflector are imaginable.

Furthermore, embodiments are imaginable, in the case of which the wall areas define a plurality of steps.

In the following, preferred dimensions of the dual-polarized antenna according to the present invention will be described in more detail. The individual measurements are advantageous each individually and can be combined in an arbitrary manner.

As far as the measurements are indicated depending on lambda, lambda is the wavelength of the center frequency of the lowest resonance frequency range of the respective radiator.

Quite generally, a resonance frequency range referred to within the scope of the present invention is a continuous frequency range of the radiator having a return loss of better than 6 dB, or better than 10 dB, or better than 15 dB. The individual limit values of the return loss depend on the concrete application of the antenna. The center frequency is defined as the arithmetic mean of the highest and the lowest frequency in the resonance frequency range.

According to the present invention, the resonance frequency range and, consequently, the center frequency are preferably determined with respect to the impedance position in the Smith chart, assuming subsequent elements for optimum impedance matching and/or impedance transformation.

The wavelength lambda is here the wavelength in the respective medium. It follows that, if the cavity is filled with a dielectric, the dimensions of the cavity and of the slot will refer to the wavelength in the dielectric.

Within the framework of the use of the dual-polarized antenna according to the present invention, the lowest resonance frequency range is preferably understood to be the lowest antenna resonance frequency range used for transmitting and/or receiving.

Preferably, the collar-shaped wall areas extending along the edges of the slot have, in the direction of height, a dimension between 0.01 lambda and 0.4 lambda, preferably between 0.05 lambda and 0.2 lambda. Lambda is here the wavelength of the center frequency of the lowest resonance frequency range of the resonant cavity radiator. According to a preferred embodiment of the present invention, the wall areas may have a constant height.

According to the present invention, the cavity resonator radiates through a slot in the reflector. The cavity of the cavity resonator is therefore broader than the slot, at least in a subarea thereof. According to the present invention, this has the advantage that the dipole radiator is better decoupled from the resonant cavity radiator and/or achieves a higher directivity, since it essentially interacts with the reflector.

Preferably, the sidewalls of the cavity of the resonant cavity radiator, which extend in the longitudinal direction of the slot, are, in the width direction, spaced apart from the edges of the slot. According to a specially preferred embodiment, the sidewalls follow the shape of the edges of the slot, in particular at a certain distance therefrom.

Preferably, the distance between the sidewalls and the edges is, in the width direction, smaller than 0.25 lambda and further preferred smaller than 0.15 lambda, lambda being the wavelength of the center frequency of the lowest resonance frequency range of the resonant cavity radiator. Alternatively or additionally, the distance between the sidewalls and the edges may, in the width direction, be larger than 0.05 lambda and preferably larger than 0.1 lambda, lambda being the wavelength of the center frequency of the lowest resonance frequency range of the resonant cavity radiator.

Alternatively or additionally, the distance between the sidewalls and the edges may, in the width direction, be between 0.5 times and 1.5 times the smallest width of the slot.

Specially preferred, the distance between the sidewalls and the edges may, in the width direction, be constant, i.e. the sidewalls follow the course of the edges at a constant distance therefrom.

Also in the longitudinal direction, the sidewalls may be spaced apart from the end of the slot. In this case, the distance in the longitudinal direction will be less than 0.25 lambda and further preferred less than 0.15 lambda, lambda being the wavelength of the center frequency of the lowest resonance frequency range of the resonant cavity radiator.

However, according to an alternative embodiment, the distance between the sidewalls may, in the longitudinal direction of the slot, correspond to the length of the slot.

Through one of the above-mentioned dimensions, a radiator is obtained, which is very compact in the width direction on the one hand and which exhibits a good radiation characteristic on the other.

Particularly preferred, the cavity of the resonant cavity radiator is defined by a base plate, sidewalls and a ceiling plate. Optionally, the base plate and/or the sidewalls and/or the ceiling plate may here also be produced in one piece from a metal plate and may be interconnected via folds. Preferably, the slot is here arranged in the ceiling plate according to the present invention. According to a possible embodiment, the base plate and the ceiling plate may extend parallel to one another. Alternatively or additionally, the sidewalls may extend perpendicular to the base plate and/or the ceiling plate. The ceiling plate has preferably attached thereto the collar-shaped wall areas, which extend along the edges of the slot. The housing, which defines the cavity, and in particular the base plate and/or the sidewalls and/or the ceiling plate and/or the collar-shaped wall areas consist of a conductive material, in particular a sheet metal plate.

According to the present invention, the ceiling plate may electrically define a part of the reflector. According to a possible structural design, a reflector plate may be provided, which extends parallel to the ceiling plate of the cavity. The reflector plate may have an opening, in which the ceiling plate is installed—preferably in a flush mode of arrangement. Alternatively, the ceiling plate may be arranged below the reflector plate, so that the opening in the reflector plate is smaller than the ceiling plate. Preferably, the collar-shaped wall areas arranged on the edges of the slot are secured to the ceiling plate of the cavity and project through the opening in the reflector plate upwards.

Alternatively, the ceiling plate and the reflector plate may be formed in one piece and may be defined by a single plate.

According to a further embodiment, the base plate and/or the sidewalls and/or the ceiling plate may additionally have openings in their material and/or may consist of a metal grid, so as to reduce the weight and/or improve the electrical characteristics, such as far field and bandwidth. Openings in the material at locations of high and/or low electric field strengths are here particularly preferred.

According to a preferred embodiment of the present invention, the slot has at the narrowest point thereof a first width, which is smaller than 0.25 lambda and preferably smaller than 0.15 lambda. Alternatively or additionally, the slot may have at the widest point thereof a second width, which is smaller than 0.5 lambda and preferably smaller than 0.3 lambda. Lambda is here in both cases the wavelength of the center frequency of the lowest resonance frequency range of the resonant cavity radiator.

Alternatively or additionally, the slot may have in a central area, when seen in the longitudinal direction, its smallest width and in the areas, which are arranged next to the central area when seen in the longitudinal direction, a larger width.

Preferably, the slot has in the central area thereof a constant first width. Alternatively or additionally, the central area may have a length of 0.1 lambda to 0.5 lambda, preferably of 0.2 lambda to 0.3 lambda. Lambda is the wavelength of the center frequency of the lowest resonance frequency range of the resonant cavity radiator.

According to a further preferred embodiment, the width of the slot may gradually increase outwards to a second width in the outer areas arranged next to the central area. Preferably, the width gradually increases to the second width along a first subarea in the outer areas.

Alternatively or additionally, the width in a second subarea of the outer areas may be constant. Further alternatively or additionally, the width may gradually decrease outwards in a third subarea.

Furthermore, the difference between the smallest and the largest width may, according to the present invention, be larger than 0.05 lambda and further preferred larger than 0.1 lambda. Lambda is here the wavelength of the center frequency of the lowest resonance frequency range of the resonant cavity radiator. Alternatively or additionally, the difference between the smallest and the largest width may be between 0.5 times and 1.5 times the smallest width.

Particularly preferred, the slot has here the shape of a barbell and/or of a bone.

Alternatively or additionally, the slot may have a shape that is mirror-symmetrical with respect to the respective center line in the longitudinal direction and/or in the width direction.

According to a possible embodiment of the present invention, the slot may have a total length of 0.2 lambda to 1.0 lambda, preferably 0.4 lambda to 0.8 lambda. Particularly preferred, the length is between 0.4 lambda and 0.6 lambda. Lambda is the wavelength of the center frequency of the lowest resonance frequency range of the resonant cavity radiator.

The use of a slot having one of the above-mentioned dimensions increases the width of the resonance frequency range of the resonant cavity radiator.

The cavity of the resonant cavity radiator has the same length as or a greater length than the slot in the longitudinal direction of the slot.

Alternatively or additionally, the cavity of the resonant cavity radiator has, in the longitudinal direction of the slot, a length between 0.3 lambda and 1.5 lambda, preferably between 0.5 lambda and 1.0 lambda. Lambda is here the wavelength of the center frequency of the lowest resonance frequency range of the resonant cavity radiator.

Alternatively or additionally, the cavity of the resonant cavity radiator may have a shape, in the longitudinal direction and/or in the width direction, that is mirror-symmetrical with respect to the respective center plane extending perpendicular to the plane of the reflector.

According to a preferred embodiment of the present invention, the cavity resonator comprises an excitation structure, which is arranged at a distance of between 0.05 lambda and 0.6 lambda, preferably of between 0.15 lambda and 0.35 lambda, above the bottom of the cavity of the cavity resonator. Alternatively or additionally, the cavity resonator may comprise an excitation structure, which is arranged at a distance of between 0.05 lambda and 0.6 lambda, preferably of between 0.15 lambda and 0.35 lambda, below an upper edge of the slot. If the slot is defined by wall areas extending in the height direction, the upper edge of the slot is defined by the upper edge of these wall areas in the height direction. Lambda is the wavelength of the center frequency of the lowest resonance frequency range of the resonant cavity radiator.

The above arrangement of the excitation structure leads to a particularly good resonance and radiation characteristic of the resonant cavity radiator.

The dipole radiator is arranged preferably at a distance of between 0.1 lambda and 0.6 lambda, preferably of between 0.15 lambda and 0.35 lambda, above the reflector. Lambda is here the wavelength of the center frequency of the lowest resonance frequency range of the dipole radiator. Alternatively or additionally, the dipole may have a length between 0.3 lambda and 0.7 lambda, preferably between 0.4 and 0.6 lambda. Also in this case, lambda is the wavelength of the center frequency of the lowest resonance frequency range of the dipole radiator.

If the dipole is arranged at a distance of between 0.15 lambda and 0.35 lambda above the reflector, the latter will have a directional far field characteristic, and a distance of between 0.4 lambda and 0.6 lambda will result in a bidirectional far field characteristic.

According to a preferred embodiment of the present invention, the respective reflector areas arranged next to the slot have, in the width direction of the slot, starting from the respective edge of the slot, a width which is at least twice as large as the minimum width of the slot. Preferably, the width is at least twice as large as the maximum width of the slot. Further preferred, the width of the respective areas of the reflector is at least four times as large, and still further preferred at least six times as large as the minimum width of the slot, further preferred it is at least four times and still further preferred at least six times as large as the maximum width of the slot. Through the width of the reflector and/or of the slot it is ensured that the dipole radiator will electrically interact essentially only with the reflector, and will therefore not be influenced by the cavity resonator of the resonant cavity radiator and will achieve a high directivity and small radiation angles.

The reflector according to the present invention extends preferably in a plane. The above-mentioned indications of width refer to the extension of the reflector in this plane. In its edge area, the reflector may additionally have angled sections. The reflector may here be defined mechanically by a single reflector plate or by a combination of a plurality of plates.

The dipole radiator and the cavity radiator of the dual-polarized antenna according to the present invention preferably have different polarizations. In particular, the polarizations are here orthogonal to one another.

Alternatively or additionally, the dipole radiator may extend in the longitudinal direction of the slot. Preferably, the dipole radiator extends above the slot along the center line of the slot. Alternatively or additionally, the dipole radiator is oriented symmetrically to the edges of the slot in the longitudinal direction and/or in the width direction.

According to the present invention, it is thus possible to achieve, by the combination of dipole radiator and cavity radiator, orthogonal polarizations of the respective radiators, although they extend along the same longitudinal axis. This is due to the fact that the dipole radiator defines an electric dipole. The cavity radiator, which radiates through the slot, defines, however, a magnetic dipole along the slot, so that the respective polarizations of the dipole radiator and of the magnetic dipole are perpendicular to one another. In this way, an arrangement is accomplished, which is extremely compact in the width direction of the slot.

Preferably, the dipole radiator and the resonant cavity radiator have substantially the same resonance frequency range or ranges. Preferably, at least 60% of at least a resonance frequency range of one of the radiators is comprised in a resonance frequency range of the other radiator, further preferred at least 80%.

Alternatively or additionally, the two radiators may be adapted to be used for the same frequency bands, i.e. they may be used for receiving and/or transmitting in the same frequency bands.

The dipole radiator according to the present invention and the resonant cavity radiator according to the present invention have separate ports and may thus by supplied with signals separately.

The dual-polarized antenna according to the present invention is particularly suitable for being combined with at least one further antenna and preferably with a plurality of further antennas so as to form an antenna array. The further antenna or antennas may here be further dual-polarized antennas according to the present invention as well as antennas which are not configured as described in the present invention, but which may, optionally, also be dual-polarized antennas.

Hence, the present invention further comprises an antenna array, which comprises at least one dual-polarized antenna of the type described in more detail hereinbefore as well as at least one further antenna. Preferably, the antenna array comprises a plurality of further antennas. The further antenna or antennas may here be dual-polarized antennas according to the present invention, of the type described hereinbefore, and/or further antennas which are not configured as described in the present invention.

According to a possible embodiment of an antenna array according to the present invention, the further antenna may be arranged next to the dipole radiator on the reflector. Preferably, the further antenna is here arranged next to the dipole radiator on the reflector in the width direction of the slot. The further antenna may, in the longitudinal direction of the slot and of the dipole radiator, respectively, preferably be arranged on the same level as the dipole radiator. In particular, the center of the further antenna and the center of the dipole radiator are arranged on the same level in the longitudinal direction of the slot.

Alternatively or additionally, at least two further antennas may be arranged next to the dipole radiator, the antennas being preferably arranged symmetrically with respect to the center axis of the dipole radiator, when seen in the longitudinal direction of the slot.

According to a specially preferred embodiment of the present invention, at least one antenna is arranged on both sides of the dipole radiator. Optionally, also a plurality of further antennas may be arranged on both sides. Preferably, the antennas arranged on the respective sides of the dipole radiator are arranged mirror-symmetrically with respect to a plane, which is perpendicular to the reflector and which extends in the longitudinal direction of the slot and/or of the dipole radiator.

The above-mentioned antenna or antennas are preferably dual-polarized antennas. However, these antennas need not be configured as described in the present invention. On the contrary, also dual-polarized antennas in the case of which both polarizations are provided by dipoles may be used. In particular, the further antennas may be antennas, which comprise two orthogonally oriented dipole radiators, in particular dipole squares.

Preferably, the further antennas are antennas for a different frequency band. Preferably, the antennas in question are antennas for a higher frequency band. Alternatively or additionally, the further antenna or antennas may here have a resonance frequency range which is different from that of the radiators of the dual-polarized antenna according to the present invention, in particular a higher lowermost resonance frequency range.

Further alternatively or additionally, the further antenna or antennas may have a lower height above the reflector than the dipole radiator of the antenna according to the present invention.

Preferably, the at least one further antenna is spaced apart from the dipole radiator according to the present invention at a distance that is smaller than 2 lambda and further preferred smaller than 1 lambda, lambda being the wavelength of the center frequency of the lowest resonance frequency range of the dipole radiator. The distance is here preferably defined as the smallest distance between a radiating area of the further antenna and a radiating area of the dipole radiator according to the present invention projected into the reflector plane. Preferably, the distance is smaller than 0.7 lambda.

According to the present invention, the further antenna or further antennas may couple as parasitic elements with the dipole radiator and/or the resonant cavity radiator of the antenna according to the present invention. In this way, a very narrow far field diagram of the radiator is accomplished. If a symmetrical arrangement of the further antennas around the dipole radiator according to the present invention is here chosen, the far field will be symmetrically influenced accordingly.

According to an alternative embodiment of the present invention, the antenna array may comprise a plurality of antennas according to the present invention, of the type described hereinbefore. The antennas according to the present invention have here preferably a common reflector plane. In particular, the antennas may have a common reflector. By way of example, the reflector used may be a common metal plate with openings for the respective upper sides of the cavity resonators and the slots of the resonant cavity radiators according to the present invention. However, the reflector plane may mechanically also be composed of a plurality of individual reflector plates.

According to a first embodiment, a plurality of antennas according to the present invention, of the type described above, may be arranged side by side in a row. Preferably, the antennas have alternating, further preferred mutually orthogonal orientations. The embodiments of the slot and of the cavity resonator preferred according to the present invention allow here a particularly compact arrangement of the individual antennas relative to one another.

A plurality of such rows of antennas according to the present invention may here be arranged side by side. In this case, the antennas have, preferably also in a direction perpendicular to the rows, alternating orientations, further preferred mutually orthogonal orientations.

According to a further embodiment, at least four antennas according to the present invention of the type described hereinbefore may be arranged in a square to one another. In particular, the respective slots may here be arranged on the legs of a square.

The antenna arrays according to the present invention, in which a plurality of antennas according to the present invention are combined with one another, may also comprise further antennas, which may possibly not be configured as described in the present invention.

In particular, a combination with the above-described example of a combination with at least one further antenna, which is arranged on the reflector, is here imaginable.

Further antennas may, in particular, be arranged on the reflector inside and/or outside the square. Alternatively or additionally, a row of further antennas may be arranged next to one or a plurality of rows of antennas according to the present invention.

BRIEF DESCRIPTION OF THE FIGURES

The present invention will now be described in more detail, making reference to embodiments as well as to drawings

DETAILED DESCRIPTION

Figure 1:
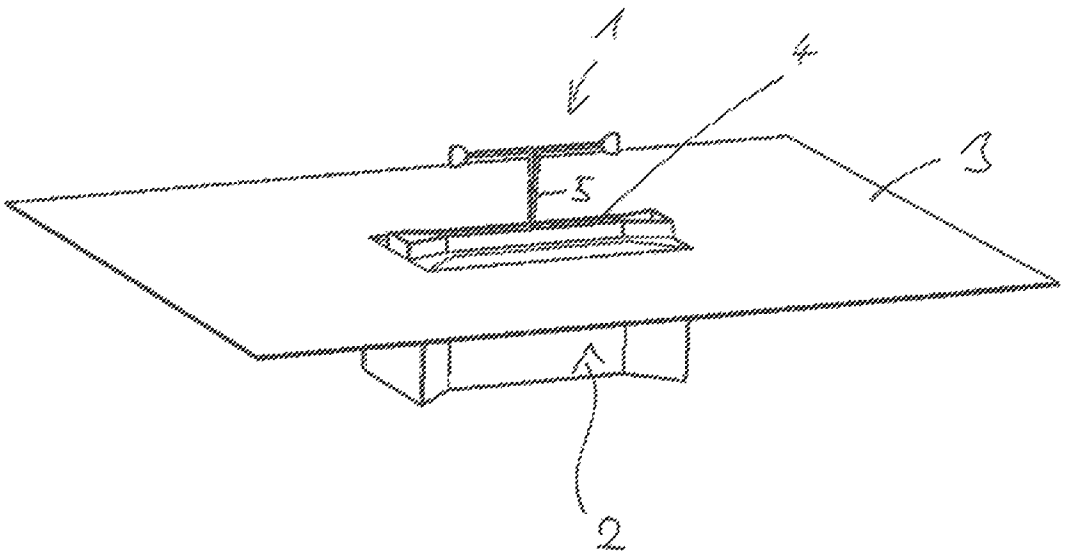
FIG. 1 shows a perspective view of an embodiment of the dual-polarized antenna according to the present invention.
Figure 2:
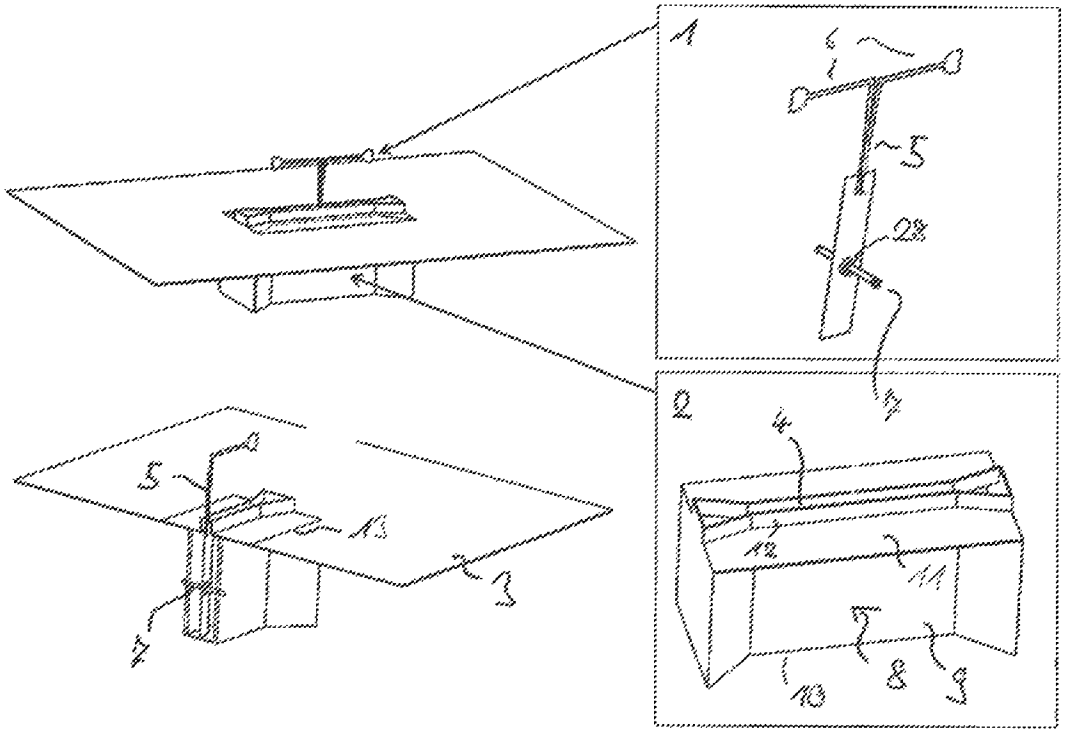
FIG. 2 shows an exploded view as well as a sectional view of the embodiment shown in FIG. 1.

FIGS. 1 to 3 discloses an embodiment of a dual-polarized antenna according to the present invention. The dual-polarized antenna according to the present invention is preferably an antenna for a mobile phone base station. The antenna is here used for transmitting and/or receiving mobile signals in a base station of a mobile phone network.

According to the present invention, the two radiators 1 and 2, which generate the two polarizations of the dual-polarized antenna according to the invention, are different in nature. The radiators 1 and 2 have, however, a common reflector 3. The two radiators are arranged with respect to the reflector 3 such that the polarization is generated above the common reflector and the other, here preferably orthogonal polarization below the common reflector 3.

According to the present invention, the first polarization is generated via a dipole radiator 1 and the second polarization via a resonant cavity radiator 2. The resonant cavity radiator 2 is arranged below the reflector and radiates through a slot 4 in the reflector 3. The dipole radiator 1 is arranged above the reflector, with a signal line 5 of the dipole radiator 1 extending through the slot 4.

The individual components of the dual-polarized antenna according to the present invention can clearly be seen especially in FIG. 2. On the left, the entire dual-polarized antenna is shown in a perspective view and a sectional view. On the upper right, the dipole radiator 1 is shown. The dipole radiator 1 has two dipole halves 6, which extend parallel to the plane of the reflector. The two dipole arms have signals supplied thereto via the signal lines 5. The signal lines 5 extend from the cavity of the resonant cavity radiator through the slot upwards to the two dipole halves 6.

For the sake of clarity, FIGS. 1 and 2 only show the conductive structure, which can be realized as a metallization of a printed circuit board on the one hand or as a sheet metal structure on the other. If a printed circuit board is used, also this printed circuit board extends through the slot 4 and forms a carrier for the dipole radiator 1. If a sheet metal structure is used, the signal lines simultaneously define the carrier for the dipole radiator.

The resonant cavity radiator is shown in FIG. 2 at the bottom right. The cavity 8 of the resonant cavity radiator 2 comprises a base plate 10, a ceiling plate 11 as well as sidewalls 9, which extend from the base plate to the ceiling plate. The ceiling plate 11 has arranged therein the slot 4 through which the resonant cavity radiator radiates.

In the embodiment shown in FIGS. 1 and 2, the slot 4 is surrounded by circumferentially extending, collar-shaped wall areas 12. In the present embodiment, these wall areas form a step that extends perpendicular to the reflector plane. These wall areas improve the directivity of the resonant cavity radiator. The walls of the cavity are made of an electrically conductive material, preferably of sheet metal. The excitation of the resonant cavity radiator 2 is effected by a probe 7 which extends into the cavity. The probe extends preferably parallel to the reflector plane and perpendicular to the longitudinal direction of the slot in the cavity.

In the present embodiment, the excitation structure 7 also extends through an opening 28 in the printed circuit board 19 carrying the signal lines 5 and the dipole antenna 6.

The ceiling plate 11 of the cavity 8 of the resonant cavity radiator 2 may electrically form part of the common resonator of the two radiators. In the embodiment shown in FIGS. 1 and 2, the ceiling plate 11 is, to this end, installed in a suitable opening 13 of the resonator plate such that it is flush with the latter. According to alternative embodiments, the resonator plate may, however, also be placed on top of the ceiling plate 11, or the ceiling plate 11 may be formed integrally with the resonator plate.

In the present embodiment, the resonant cavity radiator and the dipole radiator are combined so as to form an orthogonally polarized antenna. The dipole radiator 1 extends parallel to the slot 4 of the resonant cavity radiator 2.

The dipole 1 extends parallel to the slot 4 and perpendicular to the excitation structure 7 of the resonant cavity radiator. In this way, the resonant cavity radiator 2 and the dipole 1 generate polarizations that are orthogonal to each other. Due to the parallel arrangement of the slot 4 and the dipole 1, the resultant arrangement is nevertheless very compact in a direction perpendicular to the longitudinal extension of the slot 4.

Figure 3A:
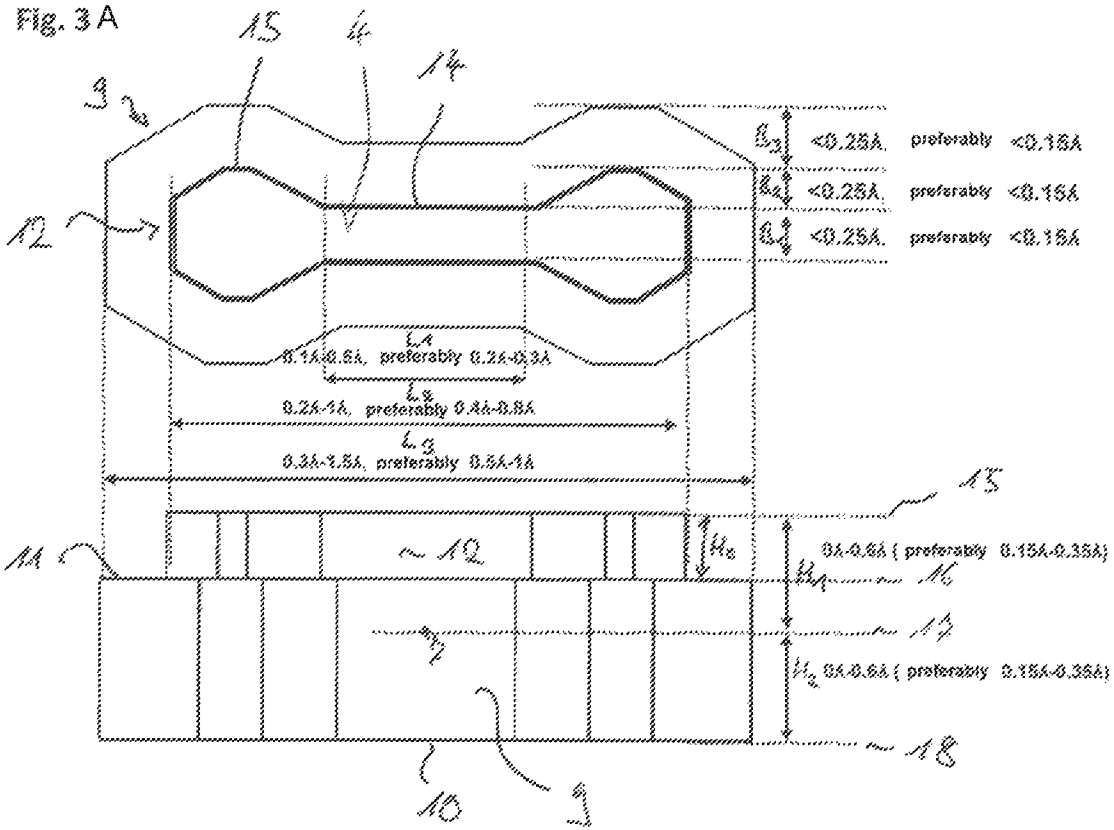
FIG. 3A shows, in a top view and in a side view, the embodiment with dimensions of the resonant cavity radiator.

Preferred dimensions of the dual-polarized antenna according to the present invention will now be described in more detail making reference to FIGS. 3A and 3B. The individual values shown on the basis of the concrete embodiment may also be used individually and independently of the other values in an advantageous manner. All the values are here related to the wavelength lambda of the center frequency of the lowest resonance frequency range of the respective radiator, i.e. with respect to the dimensions in FIG. 3A to that of the resonant cavity radiator and with respect to the dimensions in FIG. 3B to that of the dipole radiator.

A resonance frequency range is a continuous frequency range with a matching of better than 6 dB (e.g. for mobile phone antennas), or better than 10 dB (e.g. microcell antennas) or better than 14 dB (e.g. macrocell antennas). The lowest resonance frequency range is here preferably understood to be the lowest resonance frequency range used to operate the antenna.

The wavelength specified with respect to the dimension is the respective effective wavelength, i.e. the wavelength in the medium in question. It is here imaginable to fill the slot and/or the cavity with a dielectric. This can influence production costs, dimensions as well as electrical and mechanical properties.

In particular, e.g. the cavity may be filled completely with a dielectric to reduce the dimensions. In this case, the dimensions refer to the wavelength lambda in the dielectric. Alternatively or additionally, the cavity may be filled at least partially with a dielectric to bind and/or focus the electromagnetic fields in the direction of the reflector plane.

Preferred dimensions of the resonant cavity radiator will now be specified hereinafter with reference to FIG. 3A. The dimensions of the resonant cavity radiator are shown in relation to the wavelength lambda of the center frequency of the lowest frequency range of the resonant cavity radiator.

The slot 4 exhibits different widths along its extension. In a central part 14 the slot has a constant first width B1. The width B1 is less than 0.25 lambda, preferably less than 0.15 lambda.

The central area is followed on the right and left by areas, in which the width of the slot increases from the first width B1 to a second width B1+B2. In the present embodiment, the increase in width is gradual, in particular linear. B2 is smaller than 0.25 lambda, preferably smaller than 0.15 lambda. After a short portion of constant width B1+B2, the width decreases outwards again to the first width B1. Also this takes place gradually, in the present embodiment linearly.

The central area 14, in which the slot has a constant first width B1, has a length L1 between 0.1 lambda and 0.5 lambda, preferably between 0.2 lambda and 0.3 lambda.

The bone shape of the slot according to the present invention with the lateral areas 15, where the width of the slot increases from the center, increases the bandwidth of the resonant cavity radiator.

The maximum width of the slot B1+B2 is smaller than 0.5 lambda, preferably smaller than 0.3 lambda.

The total length of the slot is 0.2 lambda to 1 lambda, preferably 0.4 lambda to 0.8 lambda.

The sidewalls 9 of the cavity of the cavity resonator are arranged at a constant distance from the edges of the slot 4 in the present embodiment. In particular, the sidewalls follow the course of the slot with a substantially constant distance in the width direction. The distance between the sidewalls of the cavity and the edges of the slot in the width direction B3 is less than 0.25 lambda, preferably less than 0.15 lambda.

In the present embodiment, also the sidewalls of the cavity, which are arranged on the two longitudinal sides of the slot or of the cavity, are arranged at a certain distance from the ends of the slot in the longitudinal direction. This, however, is not absolutely necessary.

According to the present invention, the cavity resonator thus has the same shape as the slot in the reflector except for a constant distance or offset. Furthermore, the shape of the cavity resonator may be an enlarged version of the shape of the slot.

As will be shown in more detail hereinafter, the depicted shape of the cavity of the cavity resonator has advantages when a plurality of dipole antennas according to the present invention are interleaved. However, also other shapes of the slot and of the cavity are imaginable.

The total length of the cavity of the cavity resonator L3 is between 0.3 lambda and 1.5 lambda, preferably between 0.5 lambda and 1 lambda.

Preferably, B1, B2 and/or B3 amount each separately to more than 0.05 lambda, further preferred to more than 0.1 lambda.

In the present embodiment, the sidewalls 9, which extend from the base plate 10 to the ceiling plate 11, are straight in the height direction. Furthermore, these sidewalls are perpendicular to the plane of the reflector. Also steps and/or slopes are, however, imaginable.

The edges of the slot 4 are configured as a step 12, which, in the present embodiment, extends with a height H0 in a direction perpendicular to the plane of the ceiling plate 11 and of the reflector 3, respectively. This step 12 surrounds the slot 4 on all sides and provides an improved directivity. The height H0 is 0 lambda to 0.4 lambda, preferably between 0.1 lambda and 0.2 lambda.

In the embodiment according to FIGS. 1 to 3, a single step is shown, which extends upwards from the plane of the ceiling plate 11 and of the reflector 3, respectively. As will be shown hereinafter, other steps or other arrangements of the step are, however, imaginable as well.

The excitation structure 7 for the cavity resonator is preferably arranged halfway up between the upper edge 15 of the slot, which is defined by the upper edge of the angled section 12, and the lower edge of the cavity resonator, said lower edge being defined by the base plate 10. This center plane is identified by reference numeral 17 in FIG. 3.

Alternatively or additionally, the distance H1 between the height position of the excitation structure 7 and the upper edge of the slot or of the cavity resonator is between 0 lambda and 0.6 lambda, preferably between 0.15 lambda and 0.35 lambda. Further alternatively or additionally, the distance H2 between the height position 17 of the excitation structure 7 of the cavity resonator and the lower plane 18 defined by the base plate 10 may be between 0 lambda and 0.6 lambda, preferably between 0.15 lambda and 0.35 lambda.

Figure 3B:
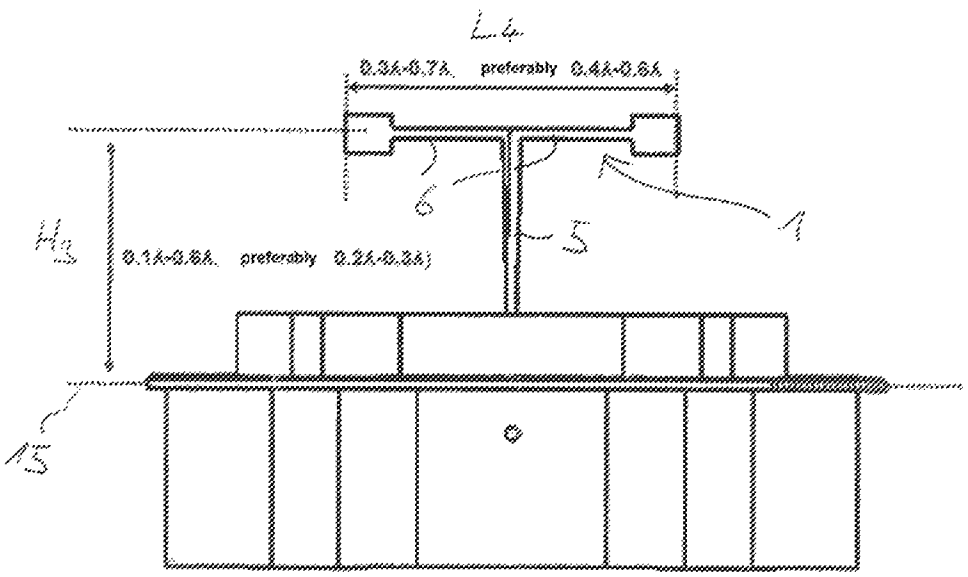
FIG. 3B shows the embodiment in a side view with dimensions of the dipole radiator.

In FIG. 3B the dimensions of the dipole radiator 1 of the present embodiment are shown. The dimensions of the dipole are shown in relation to the wavelength lambda of the center frequency of the lowest frequency range of the dipole.

The dipole 1 has a length L4 between 0.3 lambda and 0.7 lambda, preferably between 0.4 lambda and 0.6 lambda. The length L4 of the dipole 1 corresponds here to the distance between the respective outer ends of the two dipole halves 6 of the dipole 1.

Depending on the bandwidth and the antenna pattern and the desired far field characteristics, respectively, different heights H3 of the dipole 1 above the reflector plane 15 are imaginable. Preferably, the height is between 0.1 lambda and 0.6 lambda, further preferred between 0.2 lambda and 0.3 lambda or between 0.4 lambda and 0.6 lambda. For a directional antenna pattern the optimum height is 0.25 lambda, for a bidirectional antenna pattern 0.5 lambda.

Figure 4:
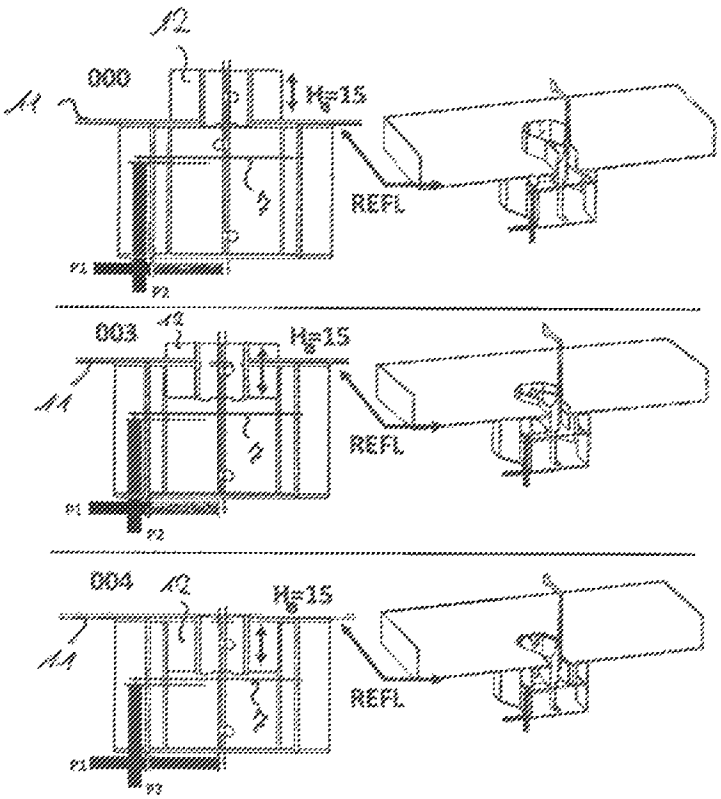
FIG. 4 shows three variants of the embodiment according to the present invention, which differ with respect to the position of the collar-shaped wall areas defining the edge of the slot.

In the following, different embodiments of the antenna according to the present invention are described in more detail:

FIG. 4 shows three embodiments, designated 000, 003 and 004, which differ with respect to the collar-shaped angled section 12 that defines the edge of the slot. In all three examples, the height H0 of the collar-shaped angled section is identical and is 15 mm in the present embodiment.

In embodiment 000 shown above in FIG. 4, the collar-shaped angled section is arranged fully above the cavity and extends upwards from the ceiling plate and the plane of the reflector 3, respectively.

In embodiment 003 shown in the middle, the angled section extends from the plane of the ceiling plate and of the reflector, respectively, both upwards and downwards into the cavity resonator.

In embodiment 004 shown below, the angled section extends, however, from the plane of the reflector and of the ceiling plate, respectively, exclusively downwards into the cavity resonator, but not upwards beyond the plane of the reflector.

All three embodiments have similar far field diagrams and similar S-parameters and thus show influences on the fine tuning of the antenna.

In the three embodiments, the position of the excitation structure 7 for the cavity resonator was adapted to the position of the upper edge of the slot, so that the excitation structure 7 is located at a distance of approx. 0.25 lambda below the upper edge of the slot in the direction of height. In embodiments 003 and 004, the excitation structure 7 has thus been arranged on a respective lower level than in embodiment 000.

In the following, several different embodiments for feeding the dipole radiator and the cavity resonance radiator will be described in more detail.

In the case of all the embodiments described, the dipole radiator may, in a first variant, be configured as a PCB radiator and may be fed by a waveguide arranged on the printed circuit board. The waveguide 5 is here a signal line defined by the metallization of the printed circuit board and is, for example, configured as a microstrip line and/or a coupled microstrip line and/or a coplanar strip line or a coplanar slot line. In the present embodiment, the signal line defined by the metallization of the printed circuit board connects the dipole halves 6 defined by the metallization of the printed circuit board to a feed point 20, at which the printed circuit board is connected to a coaxial cable 21. The use of a printed circuit board 19 as a carrier for the dipole radiator and/or the signal line is advantageous insofar as a solution could be found, which is extremely simple from the mechanical as well as from the structural point of view and by means of which the signal line and the carrier, respectively, can be passed through the slot of the resonant cavity radiator. This allows the dipole radiator to be positioned above the slot.

The printed circuit board may, optionally, also be used for impedance matching and/or for interconnecting the dipole and/or the resonant cavity radiator. Alternatively or additionally, filter structures and/or hybrid couplers and/or a balun and/or a field symmetrizing structure for feeding symmetrical and/or differential antennas and/or other structures can be integrated on the printed circuit board. In particular, also these structures may be printed circuits, i.e. elements that are provided by metallizing the printed circuit board.

The coaxial cable may be coupled to the printed circuit board both inside the cavity of the resonant cavity radiator and outside thereof. If such coupling takes place outside, a PCB subsection carrying the feed point is preferably extended to the outside of the cavity, the microstrip line 5 extending from the contact point 20 located outside the cavity into the interior of the cavity and from there through the slot to the dipole elements 6.

In a second variant, the dipole radiator may be designed as a sheet metal radiator. In this case, the dipole halves and the signal lines are defined by a sheet metal structure. The sheet structure may have the same shape and/or structural design as the metallization provided according to the first variant. Only the use of a substrate is dispensed with. Costs can thus be reduced significantly.

The excitation structure for the resonant cavity radiator extends through an opening in a sidewall of the cavity of the resonant cavity radiator into the interior of the latter, where it extends parallel to the plane of the reflector and perpendicular to the plane of the printed circuit board of the dipole and perpendicular to the longitudinal extension of the slot, respectively.

The excitation structure extends through an opening of the printed circuit board and of the sheet metal structure of the dipole, respectively.

The dipole is positioned centrally above the slot with respect to the longitudinal dimension and/or the width direction of the slot. The same applies in the present embodiment to the signal line, which extends from the upper edge of the slot upwards to the two dipole halves 6. The excitation structure for the resonant cavity radiator is arranged in the longitudinal direction centrally below the slot.

Figure 5:
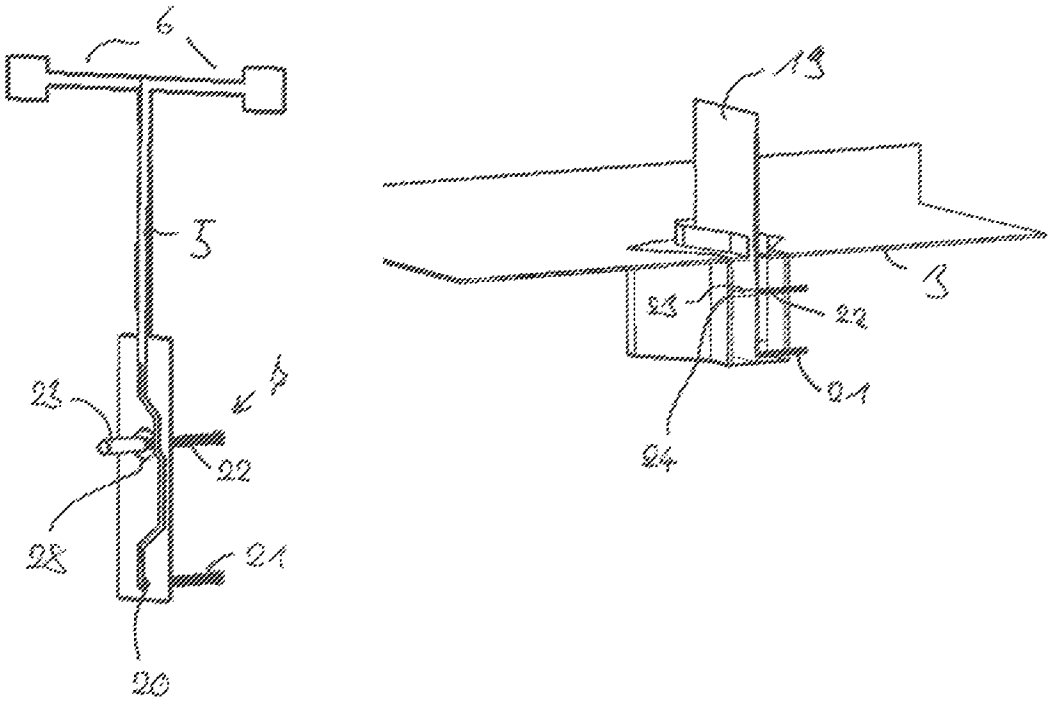
FIG. 5 shows a first variant of feeding the two radiators, with a printed circuit board being used for the dipole radiator and a coaxial cable for the resonant cavity radiator.

FIG. 5 now shows a first embodiment of feeding the dipole radiator and the resonant cavity radiator. On the left, only the metallization of the printed circuit board, which carries the signal line and the dipole, as well as the excitation structure 7 for the cavity resonator are shown. On the right, a sectional view through the antenna according to the present invention is shown, also the printed circuit board 19 itself being here depicted. Alternatively, the metallization shown on the left may also be configured as a sheet metal structure having no substrate.

The dipole is here fed via a feed point 20, which is arranged below the plane of the excitation structure 7 within the cavity of the cavity resonator. The power fed in there via the coaxial cable 21 is then fed upwards to the dipole via the waveguide 5, which is arranged on the printed circuit board or formed by the sheet metal structure and which is configured as a microstrip line. The printed circuit board 19 or the sheet metal structure and thus the dipole are thus floating in the slot of the resonant cavity radiator. Arranging the coaxial cable 21 in the bottom area is advantageous insofar as the field of the resonant cavity radiator is not interfered with by the dipole cable and will therefore be more symmetrical.

The coaxial cable 21 for feeding the dipole 6 extends here into the cavity through a sidewall of the cavity of the cavity resonator.

The excitation structure 7 for the resonant cavity radiator extends through an opening in a sidewall of the cavity of the resonant cavity radiator into the latter and extends there parallel to the plane of the reflector 3 and perpendicular to the plane of the printed circuit board 19 and perpendicular to the longitudinal extension of the slot 4, respectively. The excitation structure 7 extends here through an opening 28 through the printed circuit board 19 or the sheet metal structure.

In the embodiment in FIG. 5, the excitation structure is defined by the end of a coaxial cable 22, which projects laterally into the cavity resonator. In this embodiment, the outer conductor of the coaxial cable 22 extends only up to a point below the slot and up to the center plane of the cavity, respectively, and is removed from this point onwards. The inner conductor 23, however, extends further in the direction of the opposite sidewall. Both the outer conductor and the inner conductor may here be coupled capacitively and/or galvanically to the respective sidewalls.

Figure 6:
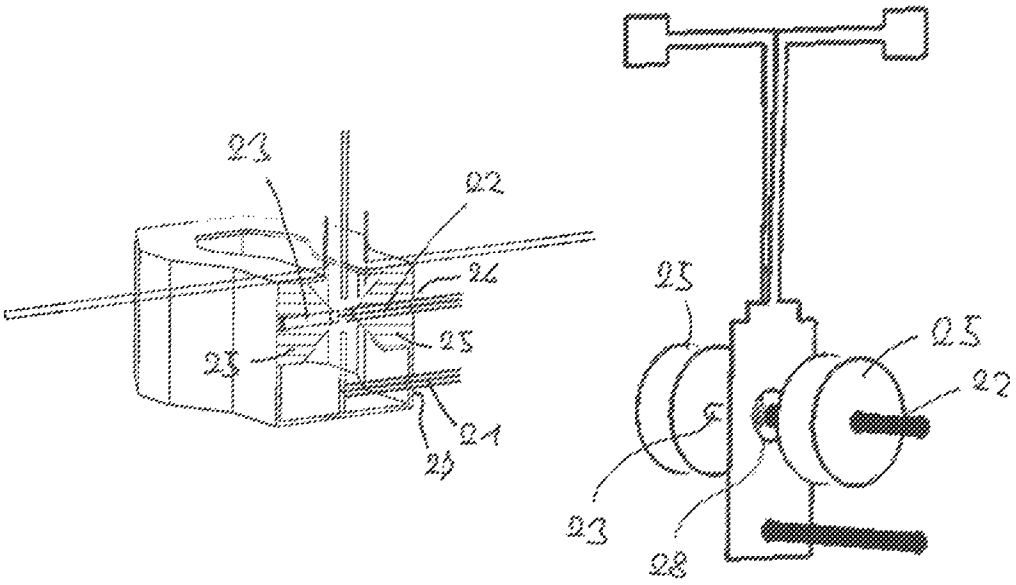
FIG. 6 shows a second variant of feeding the two radiators, with a bi-conical metal structure being used for the resonant cavity radiator.

The second embodiment shown in FIG. 6 is based on the same structural design of the excitation structure of the dipole radiator and of the resonant cavity radiator, which has already been described in connection with FIG. 5. However, in the present case, two metallic bodies 25 are additionally arranged around the two halves of the excitation structure 7. In the present embodiment, a biconical structure is thus formed. The two cone bodies 25 are each arranged in a rotationally symmetrical manner around the inner conductor 23 and the outer conductor of the coaxial cable 22, and point with their two cones towards each other. This supports the detachment of the wave from the feeder cable and/or the excitation of the resonant cavity radiator. The metallic bodies are a matching structure and/or a radiator structure of the excitation structure.

Figure 7:
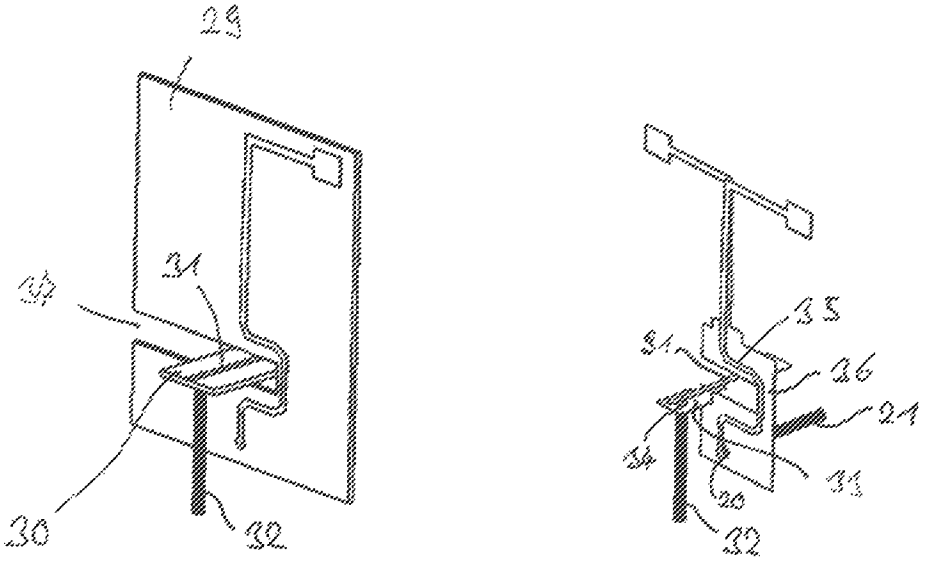
FIG. 7 shows a third variant of feeding, with printed circuit boards being used for both radiators.
Figure 8:
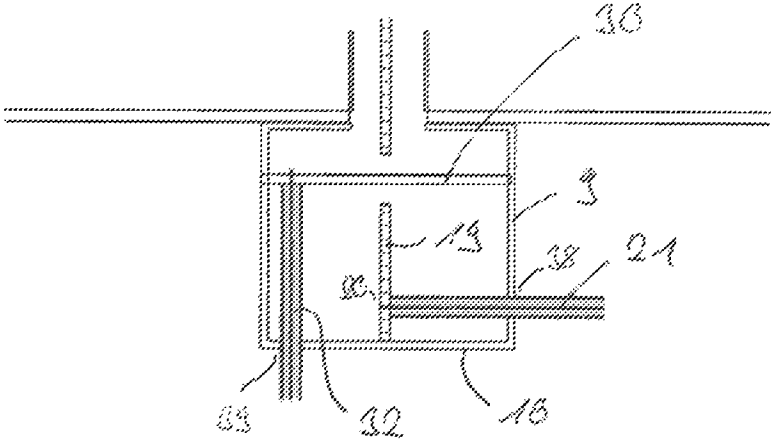
FIG. 8 shows a sectional view of the feeding shown in FIG. 7.
Figure 9:
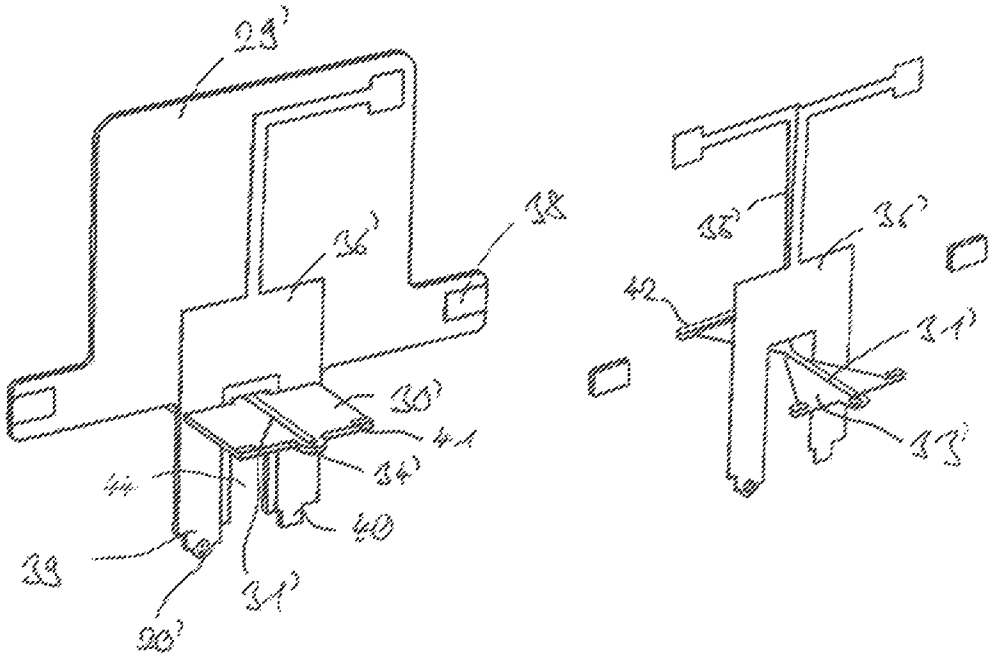
FIG. 9 shows a fourth variant of feeding the two radiators, printed circuit boards being again used for both radiators.

In the embodiments shown in FIGS. 7, 8 and 9, the resonant cavity radiator is excited by an excitation structure arranged on a printed circuit board 30 or formed by a sheet metal structure. The circuit board 30 or the sheet metal structure for excitation of the resonant cavity radiator extends here orthogonally to the printed circuit board 29 or the sheet metal structure, which carries the dipole radiator and/or the signal line 5 of the dipole radiator. FIG. 7 shows, on the left, the printed circuit board structure and, on the right, the metallization without the intermediate printed circuit boards or sheet metal structures. FIG. 8 shows a sectional view through the radiator according to the present invention.

The circuit board 29 or the sheet metal structure of the dipole each have an opening 37, 45 or 47 which is open to one side and through which the printed circuit board 30 or the sheet metal structure of the excitation structure can be pushed into an end position at which it extends through the printed circuit board 29 or the sheet metal structure of the dipole radiator. This makes installation particularly easy.

The excitation structure is here formed by a metallization strip 31 on the printed circuit board 30, which extends through the cavity resonator perpendicular to the plane of the printed circuit board 29 of the dipole and is extended beyond the center plane defined by the printed circuit board 29. The metallization 33 opposite the metallization strip 31 across the printed circuit board extends, however, only up to the center of the cavity. The two metallization strips 31 and 33 are here connected to a coaxial cable 32 via a feed point 34. Instead of a metallization, a suitable sheet metal structure may also be used in this case.

For the concrete form of the metallizations 31 and 32 and the printed circuit board 30 of the excitation structure or the respective sheet metal structure as well as for the position of the feed points different embodiments are imaginable. Also in this case, the feed point 34 may be located inside or outside the cavity resonator.

In the embodiment shown in FIGS. 7 and 8, the printed circuit board 30, which carries the excitation structure for the cavity resonator, or the sheet metal structure of the excitation structure is oriented parallel to the plane of the reflector. The feed point 34 is located in the interior of the cavity resonator, close to a sidewall, so that the coaxial cable 32 is connected to the circuit board 30 or the sheet metal structure in the interior and is extended to the outside of the cavity in a bottom area 10 through an opening 39 arranged there. In the present embodiment, also the feed point 20, which has connected thereto the coaxial cable 21 with the signal lines 35, 36 for the dipole radiator, is located within the cavity of the cavity resonator. The coaxial cable 21 is here extended to the outside through an opening 38 in a sidewall 9 of the cavity.

The feed point 20 for the dipole radiator is arranged below the feed point 34 for the resonant cavity radiator. For this purpose, the printed circuit board 29 or the sheet metal structure has an opening 37 which is open to the side and through which the printed circuit board 30 or the sheet metal structure of the excitation structure extends. The metallization 35, 36 forming the signal line 5 on the printed circuit board 29 of the dipole radiator extends in an arcuate shape from the feed point 20 at the bottom around the opening and thus around the excitation structure. If the signal lines 5 of the dipole radiator are defined by a sheet metal structure, the latter has an opening for the excitation structure through the arcuate routing of the signal lines.

Figure 10:
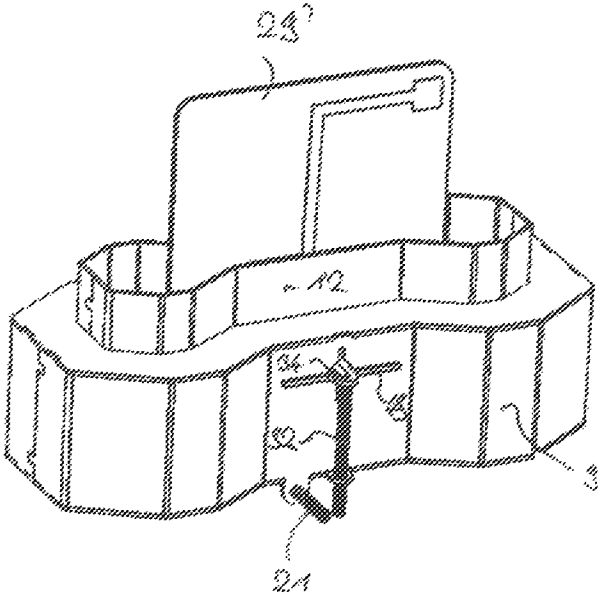
FIG. 10 shows a perspective view of the entire radiator with the feeding shown in FIG. 9.

FIG. 9 shows a further embodiment, the respective printed circuit board structures being shown on the left, whereas the metallization alone, without the printed circuit boards or the sheet metal structure, is shown on the right. FIG. 10 shows the printed circuit board structure shown in FIG. 9 installed in the cavity of the resonant cavity radiator.

In the embodiments shown in FIGS. 9 and 10, the feed points 20' and 34' for the dipole radiator and the excitation structure are each located outside the cavity of the resonant cavity radiator. The printed circuit boards 29' and 30' or the sheet metal structures used in this context have suitable extensions for this purpose, with which they extend through openings in the bottom or in the sidewall of the resonant cavity radiator.

The embodiment shown in FIGS. 9 and 10 also has a different mechanical design. The printed circuit board 29' has lateral wings 38, with which it can be connected to the sidewalls of the cavity of the resonant cavity radiator. Furthermore, it has feet 39 and 40, with which it extends through slots in the base plate. One of the feet additionally carries the feed point 20, via which the coaxial cable is connected to the metallizations 35' and 36' defining the signal lines and the dipole radiator.

The printed circuit board 30' or the sheet metal structure for the excitation structure 7 is adapted to be pushed into position via an opening 44, which is provided in the printed circuit board 29' and which is open to a lower side edge of the printed circuit board 29'. The metallizations 31' and 33' or sheet metal elements, which define the excitation structure, are each triangular in shape to increase the bandwidth.

The printed circuit board 30' or the sheet metal structure is, on both sides, mechanically fastened to the sidewalls 9 of the cavity, and in particular inserted into slots 43 provided there. Furthermore, the metallizations 31' and 33' or the sheet metal elements may here also be coupled galvanically and/or capacitively to the respective sidewalls. The feed point 34' extends centrally to the outside.

As can be seen in more detail in FIG. 10, the walls defining the cavity additionally have lugs through which the coaxial cables 21 and 32 extend and are thus mechanically held.

Figure 11:
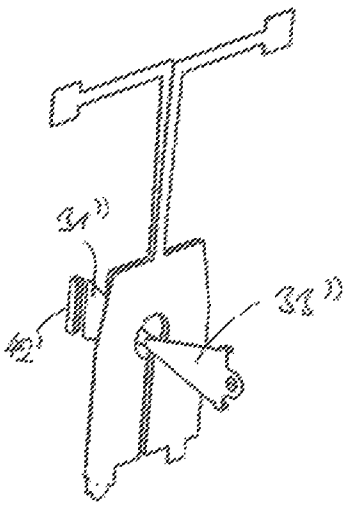
FIG. 11 shows a fifth variant of feeding, printed circuit boards being again used for both radiators.
Figure 11:
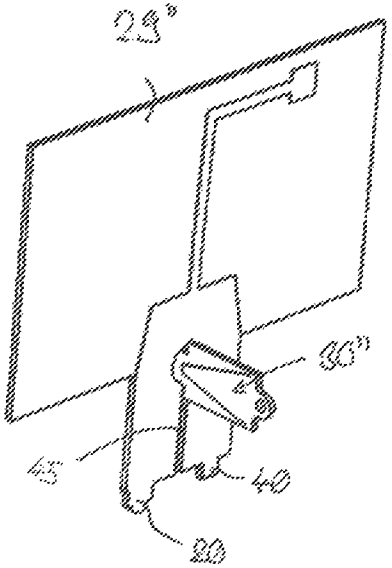
Figure 12:
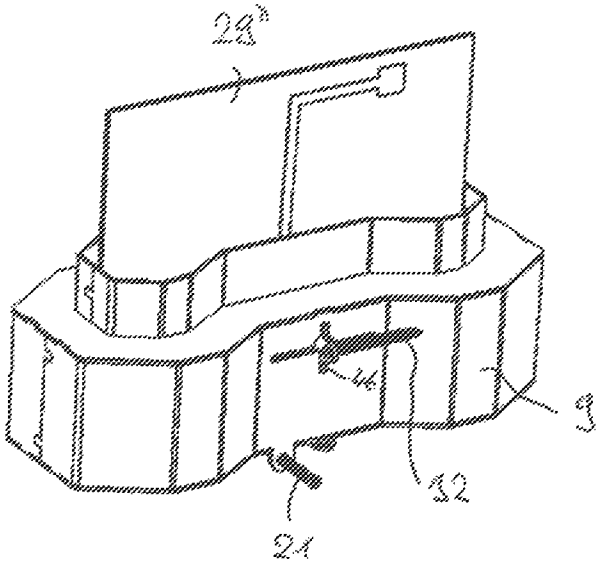
FIG. 12 shows a perspective view of the entire radiator, with the excitation structure according to FIG. 11 being used.

The embodiment shown in FIGS. 11 and 12 essentially corresponds to the embodiment shown in FIGS. 9 and 10 with the difference that the printed circuit board 30" or the sheet metal structure, which carries or defines the excitation structure, is now oriented perpendicular to the reflector plane and perpendicular to the printed circuit board 29" or the sheet metal structure of the dipole radiator. This means that only a narrow slot 45 has to be provided in the printed circuit board 29" or the sheet metal structure of the dipole radiator for inserting the printed circuit board 30' or the sheet metal structure, which carries or defines the excitation structure.

Quite generally, the ends of the respective metallization or of the sheet metal structure, which defines the excitation structure 7, may be configured such that their width exceeds that of the central part in order to facilitate the detachment of the waves. Likewise, also the ends of the two dipole halves may be enlarged in width.

The dual-polarized antenna according to the present invention is particularly well suited for use in an array antenna, in which the dual-polarized antenna according to the present invention is combined and/or interleaved with at least one further antenna so as to form an antenna array.

On the one hand, an interleaving of the antenna according to the present invention with differently configured radiators or differently configured antennas, such as vector dipoles or cross dipoles, is imaginable. The further antenna or further antennas may here be operated in the same frequency band and/or in a frequency band that is different from that of the dual-polarized antenna according to the present invention. Preferably, the further antenna or the further antennas have resonance frequency ranges that are different from the resonance frequency ranges of the dual-polarized antenna according to the present invention.

Figure 13:
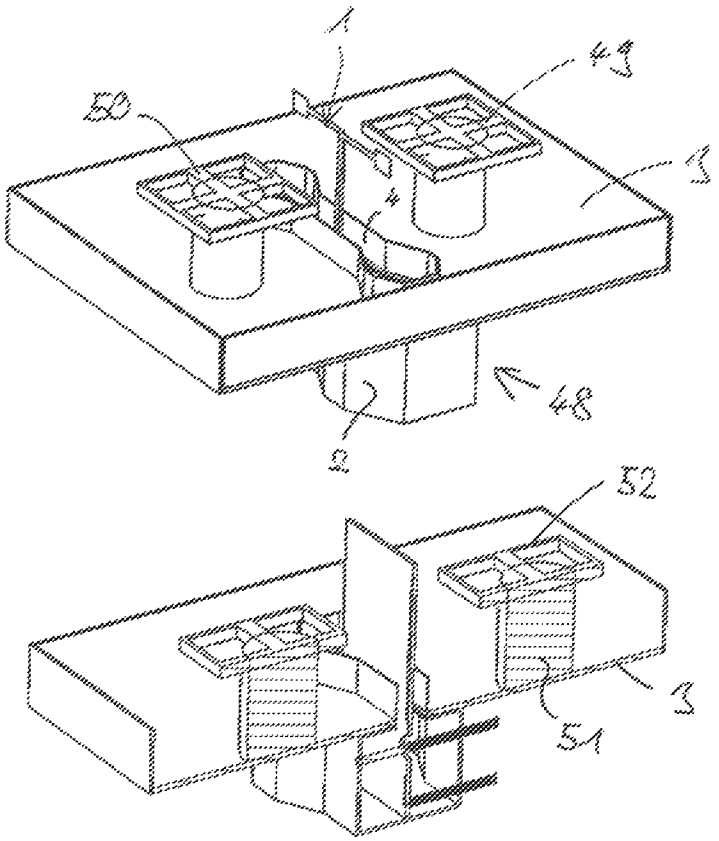
FIG. 13 shows a perspective view and a sectional view through an embodiment of an antenna array according to the present invention, comprising a dual-polarized antenna according to the present invention and two further antennas arranged on the reflector.

FIG. 13 now shows a first embodiment of such an antenna array, in which a dual-polarized antenna 48 according to the present invention has been combined with two further radiators 49 and 50. The two further radiators 49 and 50 are arranged on the reflector 3 of the antenna according to the present invention. The reflector 3 thus forms a common reflector for all the antennas.

The two further antennas 49 and 50 are dual-polarized antennas consisting of two orthogonally oriented dipole radiators, in particular two dipole squares. These dipole squares are arranged symmetrically with respect to the width direction and the longitudinal direction of the slot 4 next to the dipole 1 or the slot 4.

In the present embodiment, the further radiators are used for a frequency range above the frequency range of the antenna according to the present invention. Accordingly, the height of the antennas 49 and 50 above the reflector 3 is smaller than the height of the dipole 1.

In the present embodiment, the antenna according to the present invention is used for the frequency range 1427 to 1550 MHz and has a frequency range optimized for this purpose. The further antennas 49 and 50, however, are used for the frequency range 1695 to 2690 MHz and have a correspondingly optimized frequency range.

Figure 14:
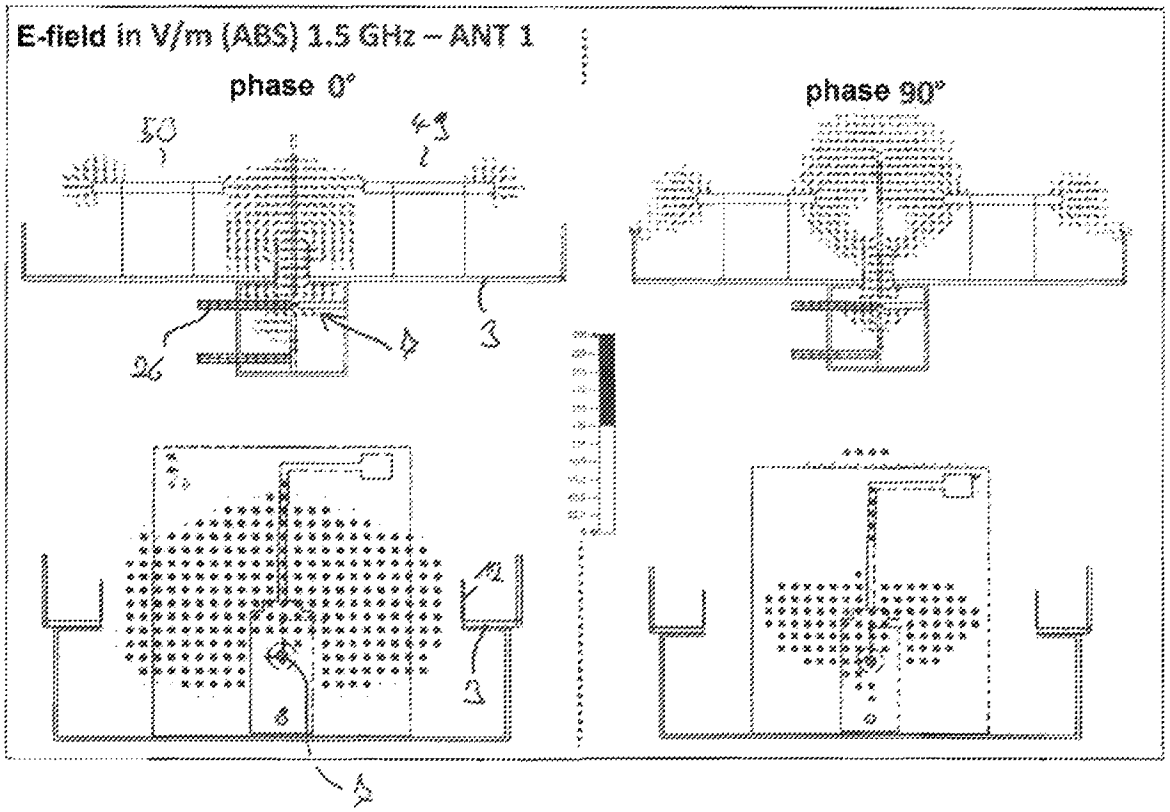
FIG. 14 shows the E-field distribution of the resonant cavity radiator in the case of the embodiment shown in FIG. 13.
Figure 15:
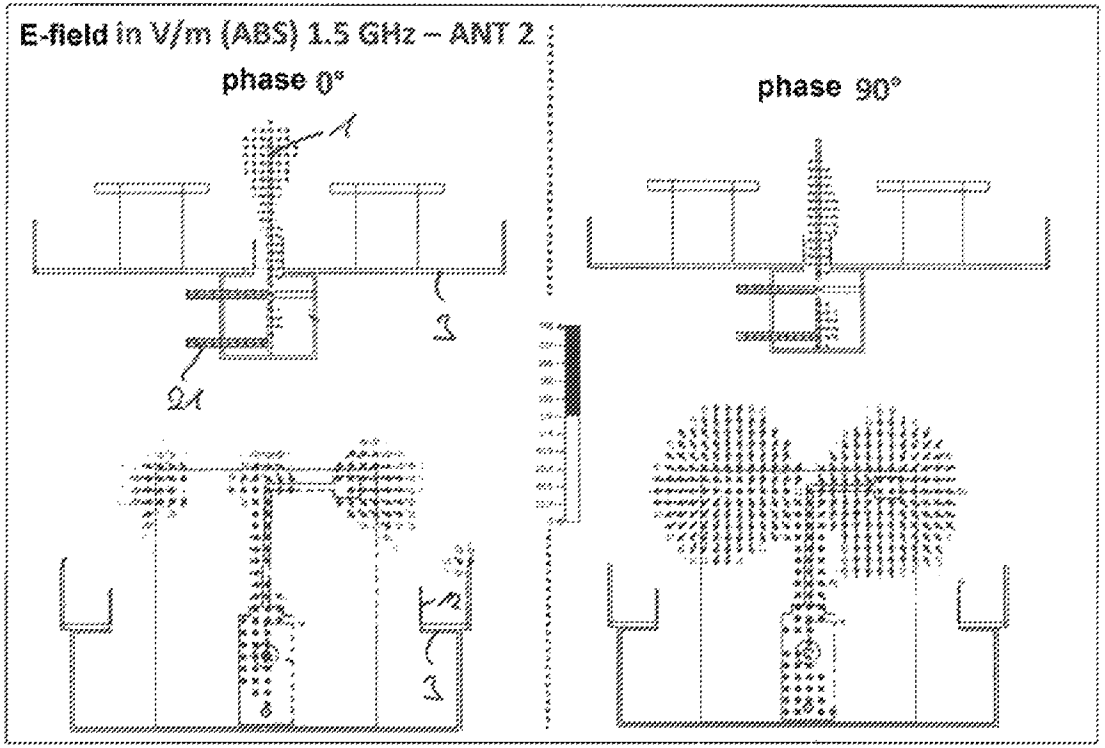
FIG. 15 shows the E-field distribution of the dipole radiator in the case of the embodiment shown in FIG. 13.

The interleaved arrangement shown in FIG. 13 is advantageous insofar as the other dipoles 49 and 50 positively influence the far field characteristics of the dual-polarized antenna 48 according to the present invention. As can be seen from the E-field distributions shown in FIGS. 14 and 15, the further antennas 49 and 50 act as parasitic elements, especially for the resonant cavity radiator, and narrow the far field diagram.

Figure 16:
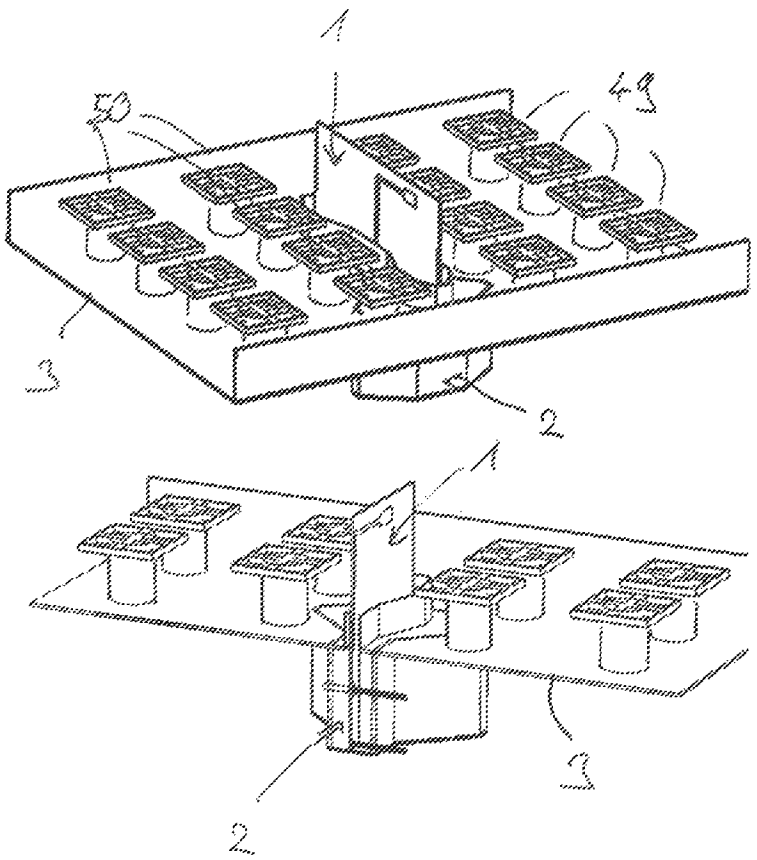
FIG. 16 shows a second embodiment of an antenna array according to the present invention, comprising a dual-polarized antenna according to the present invention and a plurality of further antennas arranged on the reflector.

A further embodiment of an antenna array with high integration density is shown in FIG. 16. In this case, the reflector 3 of the antenna according to the present invention has arranged thereon a large number of additional antennas 49 and 50. The array is symmetrical with respect to the center plane defined by the dipole 1. The further antennas are dual-polarized antennas, which consist of two orthogonally oriented dipole radiators, in particular two dipole squares, and/or antennas for a higher frequency range. In the present embodiment, two respective rows comprising each four antennas are arranged side by side in the longitudinal direction of the slot.

Alternatively or additionally to the combination with further, different antennas, several antennas according to the present invention may also be interleaved with each other. Also in this case, the antennas according to the present invention may be used for the same and/or different frequency bands or they may be used with the same and/or different resonance frequency ranges.

Figure 17:
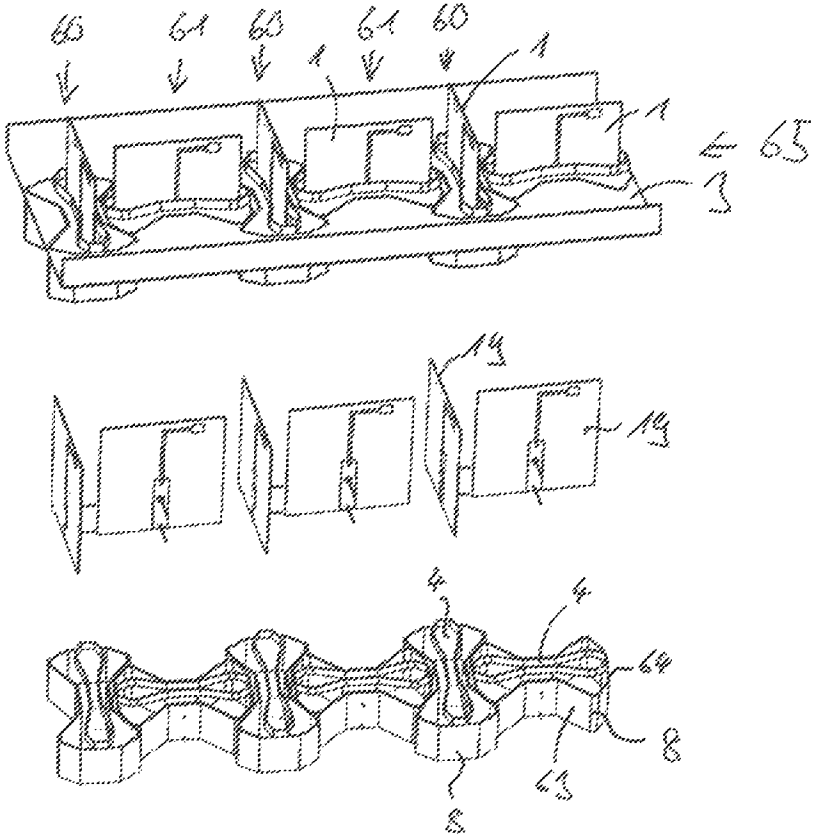
FIG. 17 shows a third embodiment of an antenna array according to the present invention, comprising a plurality of antennas according to the present invention with alternating orientation in a row.

FIG. 17 shows an array in which several antennas according to the present invention are arranged side by side in a row 65. The row comprises an alternating sequence of antennas 60 and 61 which are oriented orthogonally to one another. As shown in FIG. 17 below, the bone shape of the cavities of the resonant cavity radiators according to the present invention results in a particularly compact arrangement in the row. A common reflector plate 3 is used for the individual antennas.

Figure 18:
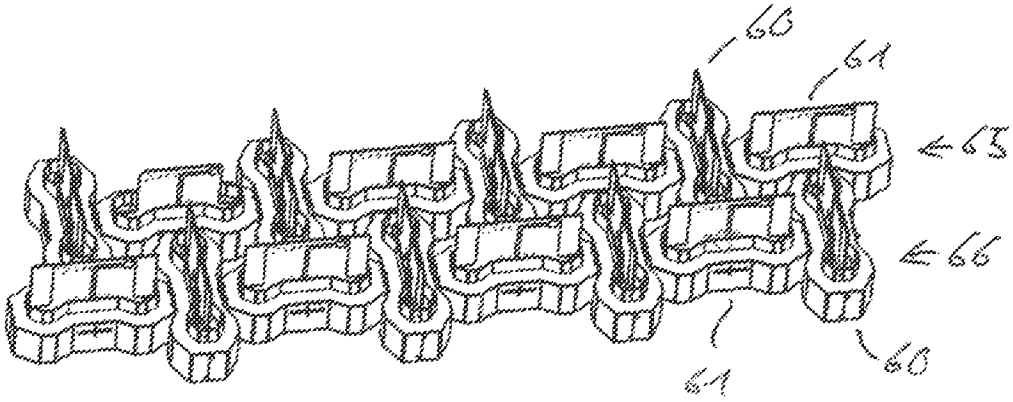
FIG. 18 shows a fourth embodiment of an antenna array according to the present invention, in which antennas according to the present invention with alternating orientation are arranged in two rows.

FIG. 18 shows a further embodiment of such an interleaved arrangement, in which two rows 65 and 66 of antennas interleaved in the way shown in FIG. 17 are arranged side by side. The antennas are here arranged such that the respective antennas are oriented orthogonally to one another in the direction of the row as well as perpendicular to the row. Also in this case a particularly compact orientation is accomplished.

Figure 19:
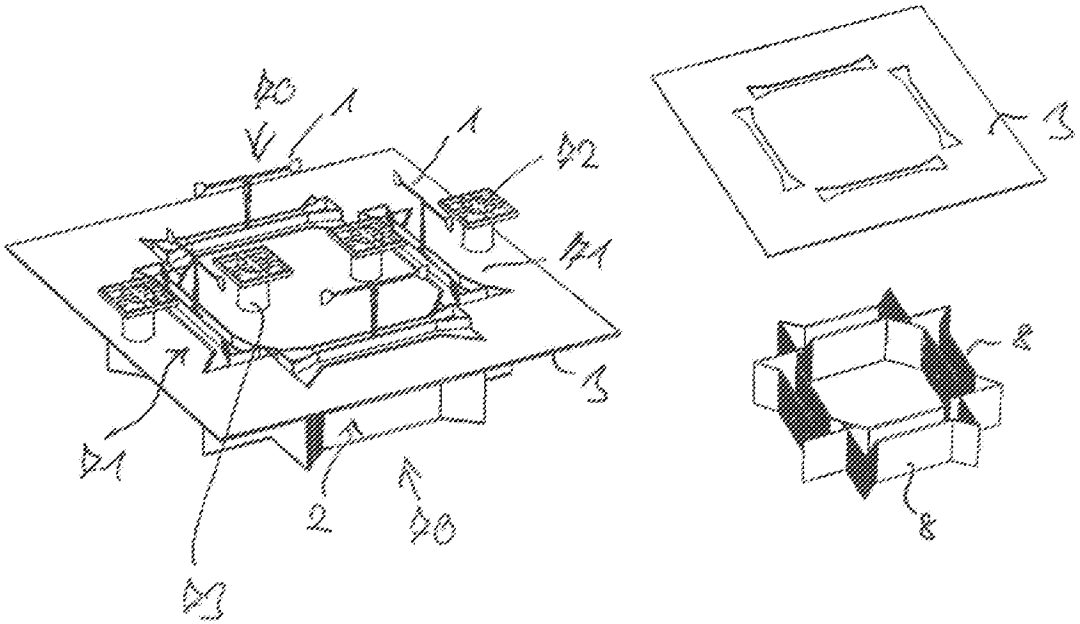
FIG. 19 shows a fifth embodiment of an antenna array according to the present invention, in which four dual-polarized antennas according to the present invention are arranged in a square.
Figure 20:
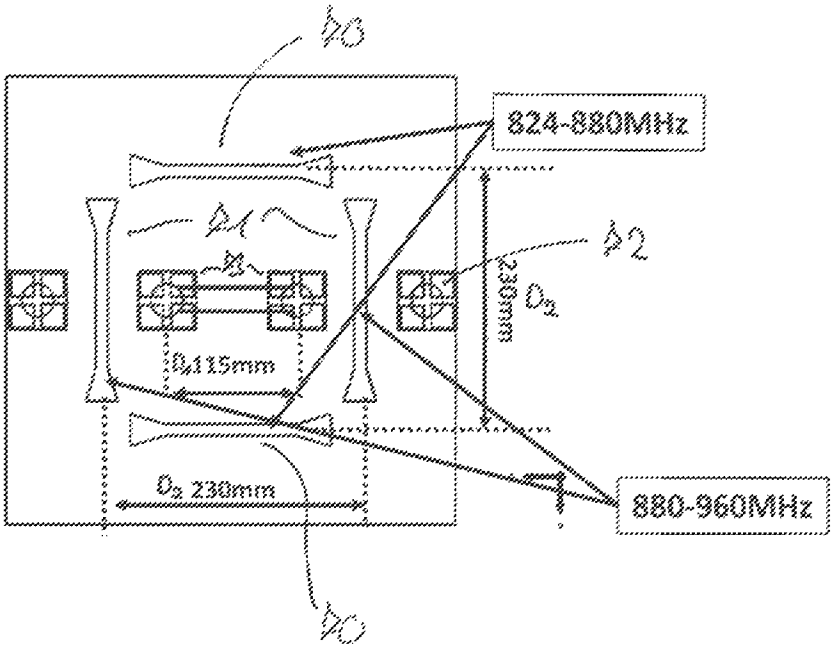
FIG. 20 shows a top view of the antenna array according to the present invention shown in FIG. 19.

In the array shown in FIGS. 19 and 20, four antennas according to the present invention are arranged in a square. In the present embodiment, two radiators 70 are optimized for the frequency band 824 to 880 MHz, and two antennas 71 for the frequency band 880 to 960 MHz. The antennas are arranged in a square with a side length D2 of 230 mm.

In addition, further radiators 73 are arranged within the square defined by the antennas according to the present invention, and further radiators 72 are arranged outside thereof. The further radiators may be optimized e.g. for the frequency bands 1696 to 2690 MHz and/or 1350 to 2170 MHz. The further radiators are preferably dual-polarized dipole radiators, which, in turn, are arranged on the common reflector 3.

According to a possible embodiment of the present invention, a plurality of radiators of the antenna or of the antenna array may be combined with each other in order to execute impedance compensation and/or phase compensation and/or far field compensation via the interconnection.

For example, independently of the combination of the antenna according to the present invention with other antennas, also the dipole radiator according to the present invention and the resonant cavity radiator according to the present invention may be interconnected.

If a plurality of radiators according to the present invention is used, also these radiators may be interconnected in an arbitrary manner. This applies in particular also to the interleaving options shown in FIGS. 17 and 18, in which the individual radiators can be interconnected in many different ways.

Furthermore, it is imaginable for all dual-polarized antennas according to the present invention to carry out a polarization rotation from a VH pole to an X pole. This can be done either by rotating the antenna in space and/or by electrically interconnecting the radiators. Such an interconnection can take place e.g. via 90°/180°, x degree hybrid couplers.

The antenna according to the present invention is characterized by a comparatively strong orientation of the far field diagram. In particular, the antenna preferably has a full width at half maximum of the far field diagram of 90° or less. If further antennas are placed next to the antenna according to the present invention, the full width at half maximum can thus be reduced to less than 80°, preferably to less than 65°.

In the present embodiment, the antenna according to the present invention has been optimized for the frequency ranges of 880 and 960 MHz. However, the radiator concept is easily scalable. In particular, it is imaginable to use the radiator concept according to the present invention for the higher frequency range. Furthermore, it is also imaginable to double or multiply the bandwidth.

Preferably, the dipole radiator and the cavity radiator have essentially identical resonance frequency ranges. In particular, the resonance frequency range of one radiator, in particular of the dipole radiator, overlaps by at least 80° of its extension with the lowest resonance frequency range of the other radiator, in particular of the resonant cavity radiator.

The invention claimed is:

1. A dual-polarized antenna comprising:

a dipole radiator;

a resonant cavity radiator; and a reflector, wherein the resonant cavity radiator is arranged below the reflector and radiates through a slot in the reflector, and wherein the dipole radiator is arranged above the reflector, with a signal line and a carrier of the dipole radiator extending through the slot;

wherein at least one conductor of an excitation structure of the resonant cavity radiator extends through an opening of the carrier, the opening of the carrier comprising an opening in a printed circuit board carrying the dipole radiator and the signal lines of the dipole radiator or in a sheet metal structure, the opening of the carrier being closed or open to the outside, and wherein the excitation structure and both conductors of the excitation structure of the resonant cavity radiator extend into a cavity through a sidewall of the cavity of the resonant cavity radiator.

2. The dual-polarized antenna according to claim 1, wherein, the dipole radiator is electrically connected, via the signal line extending through the slot, to a feed point arranged below the reflector, and wherein the dipole radiator is mechanically held, via the carrier, at a fastening point arranged below the reflector, and wherein the dipole radiator and the signal line of the dipole radiator are defined by metallization of the printed circuit board, wherein the printed circuit board extends from the cavity of the resonant cavity radiator upwards through the slot, wherein the printed circuit board comprises the feed point of the dipole radiator and one or a plurality of mechanical fastening points for fastening to the housing defining the cavity of the resonant cavity radiator, and wherein the metallization of the printed circuit board also comprises impedance matching elements or a filter structure or a symmetrizing structure for feeding symmetrical antennas.

3. The dual-polarized antenna according to claim 2, wherein the feed point of the dipole radiator is arranged below the excitation structure of the resonant cavity radiator in the cavity of the resonant cavity radiator, in a bottom area of the cavity, or outside of and below the cavity of the resonant cavity radiator, and wherein a coaxial cable is contacted in the feed point of the dipole radiator with a line arranged on the printed circuit board or defined by the sheet metal structure.

4. The dual-polarized antenna according to claim 2, wherein the excitation structure comprises at least one metallic matching structure and a radiator structure, wherein the matching structure and the radiator structure enlarge the width of the conductors of the excitation structure towards the outside, and wherein the matching structure and the radiator structure comprise a metallic body, wherein the at least one metallic body is arranged around the excitation structure of the resonant cavity radiator, wherein, a metallic body is arranged around both conductors of the excitation structure, said metallic body including further a cylindrical and conical portion, and wherein the matching structure and the radiator structure define a further radiator comprising the dipole radiator, which excites the resonant cavity radiator, and wherein the matching structure and the radiator structure act as a parasitic element.

5. The dual-polarized antenna according to claim 1, wherein collar-shaped wall areas extend along edges of the slot, wherein the collar-shaped wall areas define a step with the reflector, and wherein the collar-shaped wall areas have, in a direction of height, a dimension between 0.01 lambda and 0.4 lambda, lambda being the wavelength of the center frequency of a lowest resonance frequency range of the resonant cavity radiator, and wherein the collar-shaped wall areas have a constant height.

6. The dual-polarized antenna according to claim 1, wherein sidewalls of the cavity of the resonant cavity radiator, which extend in a longitudinal direction of the slot, are, in a width direction, spaced apart from the edges of the slot and follow a shape of edges of the slot, wherein, in the width direction, the distance between the sidewalls and the edges is smaller than 0.25 lambda, lambda being the wavelength of the center frequency of a lowest resonance frequency range of the resonant cavity radiator, and wherein, in the width direction, the distance between the sidewalls and the edges is larger than 0.05 lambda, lambda being the wavelength of the center frequency of the lowest resonance frequency range of the resonant cavity radiator, and wherein, in the width direction, the distance between the sidewalls and the edges is between 0.5 times and 1.5 times the smallest width of the slot, and wherein, in the width direction, the distance between the sidewalls and the edges is constant, and wherein the cavity of the resonant cavity radiator is defined by a base plate, the sidewalls, and a ceiling plate, wherein the slot is arranged in the ceiling plate and is surrounded by step-shaped wall areas that are arranged on the ceiling plate, the base plate and the ceiling plate extending preferably in parallel, and wherein the sidewalls extend perpendicular to the base plate and the ceiling plate.

7. The dual-polarized antenna according to claim 1, wherein the slot has at a narrowest point thereof a first width, which is smaller than 0.25 lambda, lambda being the wavelength of the center frequency of a lowest resonance frequency range of the resonant cavity radiator, and wherein the slot has at a widest point thereof a second width, which is smaller than 0.5 lambda, lambda being the wavelength of the center frequency of the lowest resonance frequency range of the resonant cavity radiator, and wherein the slot has in a central area thereof, in a longitudinal direction, a smallest width and in outer areas, which are arranged next to the central area in the longitudinal direction, a larger width, wherein the slot has in the central area thereof a constant first width, and wherein the central area has a length of 0.1 lambda to 0.5 lambda, lambda being the wavelength of the center frequency of the lowest resonance frequency range of the resonant cavity radiator, and wherein the width of the slot gradually increases outwards to a second width in the outer areas arranged next to the central area, wherein the width in the outer areas increases gradually along a first subarea to the second width and remains constantly at the second width in a second subarea and gradually decreases outwards in a third subarea, and wherein the difference between the smallest and the largest width is larger than 0.05 lambda, lambda being the wavelength of the center frequency of the lowest resonance frequency range of the resonant cavity radiator, and wherein the difference between the smallest and the largest width is between 0.5 times and 1.5 times the smallest width, and wherein the slot has the shape of a barbell and of a bone.

8. The dual-polarized antenna according to claim 1, wherein the slot has a total length L2 of 0.2 lambda to 1.0 lambda, lambda being the wavelength of the center frequency of the lowest resonance frequency range of the resonant cavity radiator.

9. The dual-polarized antenna according to claim 1, wherein a cavity of the resonant cavity radiator has, in the longitudinal direction of the slot, a length between 0.3 lambda and 1.5 lambda, lambda being the wavelength of the center frequency of the lowest resonance frequency range of the resonant cavity radiator, and wherein the resonant cavity radiator comprises an excitation structure, which is arranged at a distance of between 0.05 lambda and 0.6 lambda above the bottom of the cavity of the resonant cavity radiator, and wherein the resonant cavity radiator comprises an excitation structure, which is arranged at a distance of between 0.05 lambda and 0.6 lambda below an upper edge of the slot, lambda being the wavelength of the center frequency of the lowest resonance frequency range of the resonant cavity radiator.

10. The dual-polarized antenna according to claim 1, wherein the dipole radiator is arranged at a distance of between 0.1 lambda and 0.6 lambda above the reflector, lambda being the wavelength of the center frequency of the lowest resonance frequency range of the dipole radiator, and wherein the dipole radiator has a length of between 0.3 lambda and 0.7 lambda, lambda being the wavelength of the center frequency of the lowest resonance frequency range of the dipole radiator, and wherein the areas of the reflector arranged next to the slot have, in the width direction of the slot, starting from the respective edge of the slot, a width which is at least twice as large as the minimum width of the slot.

11. The dual-polarized antenna according to claim 1, wherein the dipole radiator and the resonant cavity radiator have different and orthogonal polarizations, and wherein the dipole radiator extends in the longitudinal direction of the slot, and wherein the dipole radiator and the resonant cavity radiator have substantially the same resonance frequency range or ranges and are adapted to be used for the same frequency bands.

12. An antenna array comprising at least one dual-polarized antenna and at least one further antenna, wherein the at least one dual-polarized antenna comprises:

a dipole radiator;

a resonant cavity radiator; and a reflector, wherein the resonant cavity radiator is arranged below the reflector and radiates through a slot in the reflector, and wherein the dipole radiator is arranged above the reflector, with a signal line and a carrier of the dipole radiator extending through the slot;

wherein at least one conductor of an excitation structure of the resonant cavity radiator extends through an opening of the carrier, the opening of the carrier comprising an opening in a printed circuit board carrying the dipole radiator and the signal lines of the dipole radiator or in a sheet metal structure, the opening of the carrier being closed or open to the outside, and wherein the excitation structure and both conductors of the excitation structure of the resonant cavity radiator extend into a cavity through a sidewall of the cavity of the resonant cavity radiator.

13. The antenna array according to claim 12, wherein the further antenna is arranged next to the dipole radiator on the reflector, wherein at least one further antenna is arranged on both sides of the dipole radiator, and wherein the at least one further antenna comprises dual-polarized antennas and dipole squares, and wherein the at least one further antenna comprises antennas for a different and higher frequency band and with a resonance frequency range of the radiators which is different from that of the dual-polarized antenna, and wherein the at least one further antenna has a lower height above the reflector than the dipole radiator, and wherein the at least one further antenna couples as parasitic elements to the dipole radiator and the resonant cavity radiator, and wherein the at least one further antenna is arranged symmetrically around the dipole radiator.

14. The antenna array according to claim 12, wherein each of the at least one dual-polarized antenna and the at least one further antenna having a common reflector plane and further a common reflector, and wherein each of the at least one dual-polarized antenna and the at least one further antenna are arranged side by side in a row with alternating, mutually orthogonal orientations, and wherein, each of the at least one dual-polarized antenna and the at least one further antenna are arranged in a square to one another, wherein additional further antennas are arranged on the reflector inside and outside the square.

15. The dual-polarized antenna according to claim 1, wherein the dipole radiator is electrically connected, via the signal line extending through the slot, to the feed point arranged below the reflector, and wherein the dipole radiator and the carrier of the dipole radiator are defined by the sheet metal structure, wherein, a base area of the sheet metal structure defines the signal line of the dipole radiator and the carrier of the dipole radiator extends from the cavity of the radiator upwards through the slot, and wherein a head area of the sheet metal structure defines the dipole radiator, and wherein the excitation structure for the resonant cavity radiator is provided, the excitation structure extending in the interior of the cavity of the resonant cavity radiator.

16. The dual-polarized antenna according to claim 1, wherein the dipole radiator is electrically connected, via the signal line extending through the slot, to the feed point arranged below the reflector, wherein the excitation structure for the resonant cavity radiator is provided, the excitation structure extending in the interior of the cavity of the resonant cavity radiator, wherein the two conductors defining the excitation structure are provided, the excitation structure and the two conductors, respectively, extending perpendicular to the longitudinal axis of the slot and parallel to the plane of the reflector, and wherein the two conductors are the inner conductor and the outer conductor of a coaxial cable or wherein the two conductors are defined by the metallization of a printed circuit board, wherein the first conductor extends along a first part of an associated extension parallel to the second conductor and defines together therewith a closed or open waveguide, and extends freely along a second part, and wherein one or more of the two conductors is electrically coupled with the resonator.

* * * * *